US007607866B2

(12) United States Patent
Eddowes et al.

(10) Patent No.: US 7,607,866 B2
(45) Date of Patent: Oct. 27, 2009

(54) DRILLING RIG

(75) Inventors: Will Eddowes, Bowral (AU); Gregory Wayne Broad, Bowral (AU); John Edward Bailey, Bowral (AU)

(73) Assignee: Joy MM Delaware, Inc., Wilmington, DE (US)

( * ) Notice: Subject to any disclaimer, the term of this patent is extended or adjusted under 35 U.S.C. 154(b) by 261 days.

(21) Appl. No.: 11/422,842

(22) Filed: Jun. 7, 2006

(65) Prior Publication Data

US 2007/0286707 A1 Dec. 13, 2007

(51) Int. Cl.
*E21B 19/00* (2006.01)

(52) U.S. Cl. ..... 405/259.1; 211/70; 414/22.51

(58) Field of Classification Search ..... 405/259.1, 405/259.6; 414/22.51; 211/70
See application file for complete search history.

(56) References Cited

U.S. PATENT DOCUMENTS

| | | | | | |
|---|---|---|---|---|---|
| 4,832,536 | A * | 5/1989 | Spross et al. | ..... | 405/303 |
| 5,026,218 | A * | 6/1991 | Zimmerman | ..... | 405/290 |
| 6,135,674 | A * | 10/2000 | Neilson | ..... | 405/259.1 |
| 6,302,623 | B1 * | 10/2001 | Nellson | ..... | 405/259.1 |
| 6,497,536 | B1 * | 12/2002 | Neilson et al. | ..... | 405/288 |
| 6,796,388 | B2 * | 9/2004 | O'Meley | ..... | 173/152 |
| 2004/0118578 | A1 * | 6/2004 | O'Meley | ..... | 173/152 |

* cited by examiner

*Primary Examiner*—Tara Mayo-Pinnock
(74) *Attorney, Agent, or Firm*—James Earl Lowe, Jr.

(57) ABSTRACT

A bolting apparatus and method for inserting a rod into a surface, the bolting apparatus including a base having a foot end and a head end, at least one stabilizing rod extendable from the base head end and having a stabilizing rod end adapted to contact a surface to be drilled, and a mechanism attached to the base between the base foot end and the stabilizing rod end and adapted to grip the rod.

12 Claims, 25 Drawing Sheets

DRILLING RIG

FIELD OF THE INVENTION

The present invention relates to drilling and bolting rigs which are able to be used to insert anchoring bolts into mine entries for the purposes of stabilising the strata around a mine roadway.

BACKGROUND OF THE INVENTION

Bolting apparatus which perform bolting and drilling functions are well known in the art however as mining industry moves forward the automation of bolting and drilling operations is becoming a priority in many markets around the world. The present invention seeks to assist in the automation of these apparatus.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a bolting apparatus for inserting a rod into a surface, the bolting apparatus including a base having a foot end and a head end, at least one stabilizing rod extendable from the base head end and having a stabilizing rod end adapted to contact a surface to be drilled, and a mechanism attached to the base between the base foot end and the stabilizing rod end and adapted to grip the rod.

The bolting apparatus can also include a rotation unit feed frame slidably mounted to the base, the feed frame including a base member and an upper member, at least one first frame member and at least one second frame member, the base member and upper member being secured to respective ends of the a least one first and the second frame members whereby the at least one first and second frame members are spaced apart and substantially parallel to each other, at least one first frame member being adapted to be mounted to and slide relative to the base and the at least one second frame member being able to receive a rotation unit thereon whereby the rotation unit can slide relative to the second frame member, means for moving the feed frame relative to the base, and means for moving the rotation unit relative to the feed frame.

In one embodiment, the mechanism is mounted to at least one plate, and the mechanism includes a relaxer means whereby when activated, the relaxer means reduces the gripping force of the mechanism on the rod while preventing the rod from translating laterally relative to a longitudinal axis of the rod. The mechanism receives motive power from the base via the means for moving the feed frame relative to the base. More particularly, the at least one plate is mounted to at least one of the first and or second frame members.

In one embodiment, all moving components of the mechanism retract within the footprint of the plate, and the plate is sized and shaped to allow a rod and washer plate to move vertically past the plate when the rod is collinear with the axis of rotation of the rotation unit.

In one embodiment, the mechanism includes a body and elongated arms pivotally mounted at a proximal end thereof to the body, the arms when retracted having an angle between them of between 90 degrees and 180 degrees.

The invention also provides a method of changing the connection of a rod to a rotation unit on a rig of the type having a base, and a timber jack extendable from the base, the rotation unit being moveably mounted on the base, the method comprising the step of, while the timber jack is extended, using a locating means attached to the rig base to grip the rod intermediate its ends while changing the connection of the rod to the rotation unit.

The method can also include the step of the locating means gripping the rod to prevent relative movement between the rod and the locating means, and then relaxing to allow the rod to be rotated or translated relative to the location means, by the rotation unit while the locating means continues to locate the rod.

The method can also include moving the rotation unit relative to the locating means, moving including rotational and or translational movement.

In one embodiment, the method further includes using the locating means to grip the rod to assist in the extraction of the rod from a mine surface.

The invention also provides a hydraulic circuit including at least one hydraulic cylinder and piston to be motivated with respect thereto and at least a two position control valve to actuate the hydraulic cylinder, the at least two position control valve having a first position whereby hydraulic pressure is applied so the at least one piston is motivated to extend or retract relative to the cylinder, and a second position whereby no additional hydraulic pressure is applied to the cylinder, the circuity including a circuit volume expansion means, whereby when the second position is made operational after the first position the volume of the circuit is expanded by a predetermined magnitude, thereby decreasing the pressure applied to the hydraulic cylinder without the control valve having to be moved from the second position.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

Figure 1:
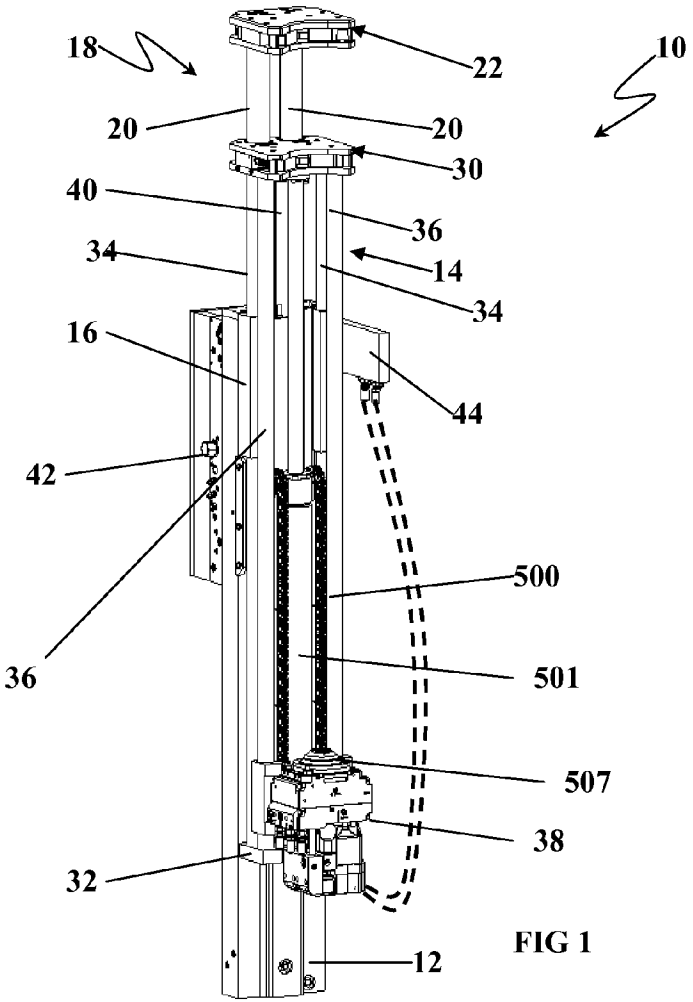
FIG. 1 is a front perspective view of a drilling or bolting rig showing the timber jack in an elevated condition with the feed frame in a partially elevated condition.

Illustrated in FIG. 1 is a rig 10 which has a base 12 and a feed frame 14 slidably mounted thereto by means of slide blocks 16 which are secured to base 12. Also included is a timber jack 18 which extends out of the base 12 by means of the piston rods 20 which terminate in an uppermost plate assembly 22. The feed frame 14 terminates in an upper plate assembly 30 and a lower plate 32 which are used to secure two first feed frame members 34 which are received in the slide blocks 16 and two second feed frame members 36 on which is slidably mounted a drill or rotation unit 38 having a drive chuck 507. The feed frame 14 is moved relative to the base 12 by means of a piston rod 40 which is moved out of the base 12 when a cylinder 40.3 (see FIGS. 8 & 26) incorporated in base 12 is pressurised, as is more clearly seen in FIG. 9.

On the rear of the base 12 is a valve and controller enclosure 42 which includes a ported block 44 extending there from for the connection of hoses shown in dotted lines in FIG. 1, to the rotation unit 38.

Figure 3:
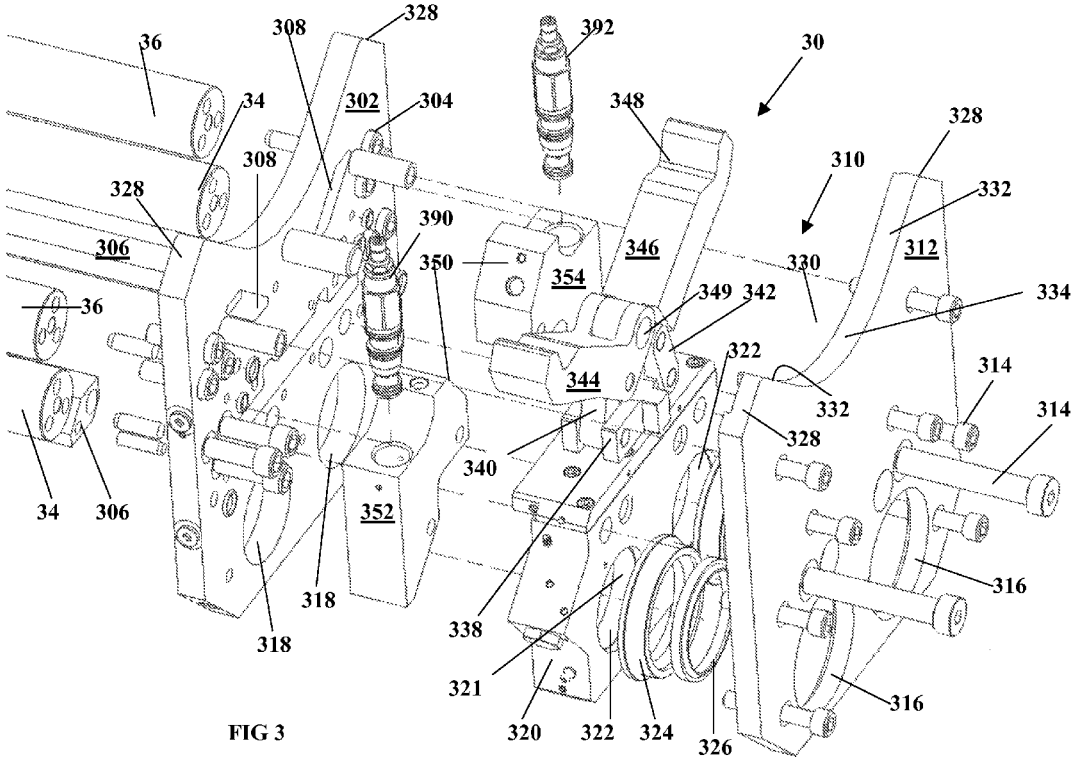
FIG. 3 illustrates an exploded perspective view of the upper plate assembly of the feed frame of FIG. 1.
Figure 4:
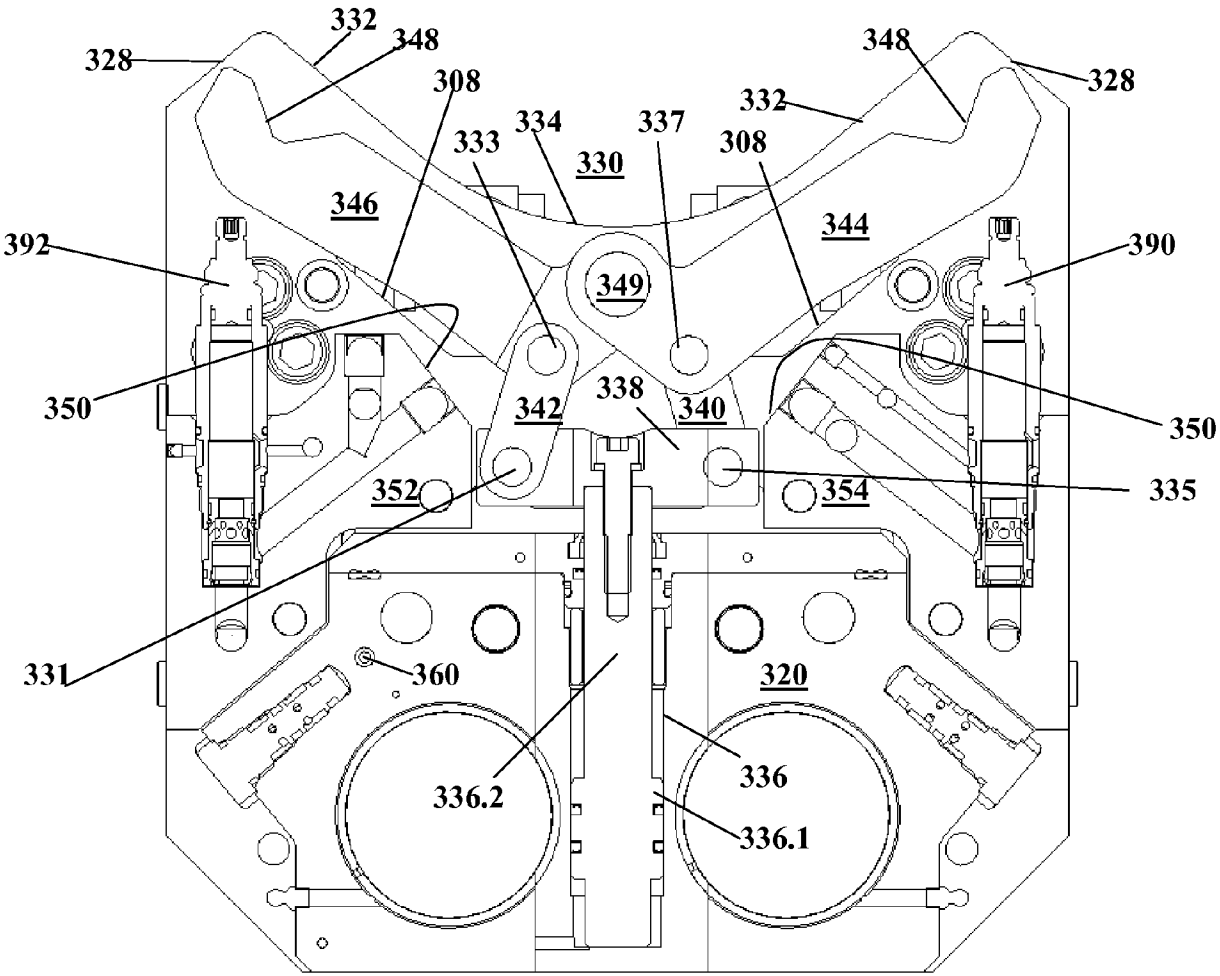
FIG. 4 illustrates a plan view showing some hidden detail of the upper member assembly of FIG. 3 in an assembled condition.

Illustrated in FIGS. 3 and 4 is the upper plate assembly 30. The plate assembly 30 is made up of a lower plate 302 which is secured to the upper ends of the first and second frame members 34 and 36 by three bolts of which only one is identified as item 304. Also connected to the plate 302 are chain securing frame members 306 which provide the anchor point for the ends of the chain 500 (see FIG. 10) a second stage feed. The securing frame members 306 provide anchor points which are located intermediate from the ends of the feed frame 14.

The lower plate 302 includes two elongated through apertures 308, whose purpose will be described in more detail later. Mounted to the plate 302 is a location mechanism 310 (also visible in FIG. 5) which can serve the functions of interacting with a rod by maintaining the rod at a set location, holding and or gripping a rod, and locating or maintaining a part of a rod on the rotation axis of a rotation unit 38. The location mechanism 310 is assembled in a sandwich fashion into the plate assembly 30 between the lower plate 302 and the top plate 312 by means a series of bolts 314 which pass through the top of the upper plate 312 and are secured into the lower plate 302. Some bolts 314 pass through the body 320 of location mechanism 310 whereas some bolts 314 pass adjacent the mechanism body 320. Two bolts pass through plates 312 and 302 to attach chain securing frame members 306.

Figure 27:
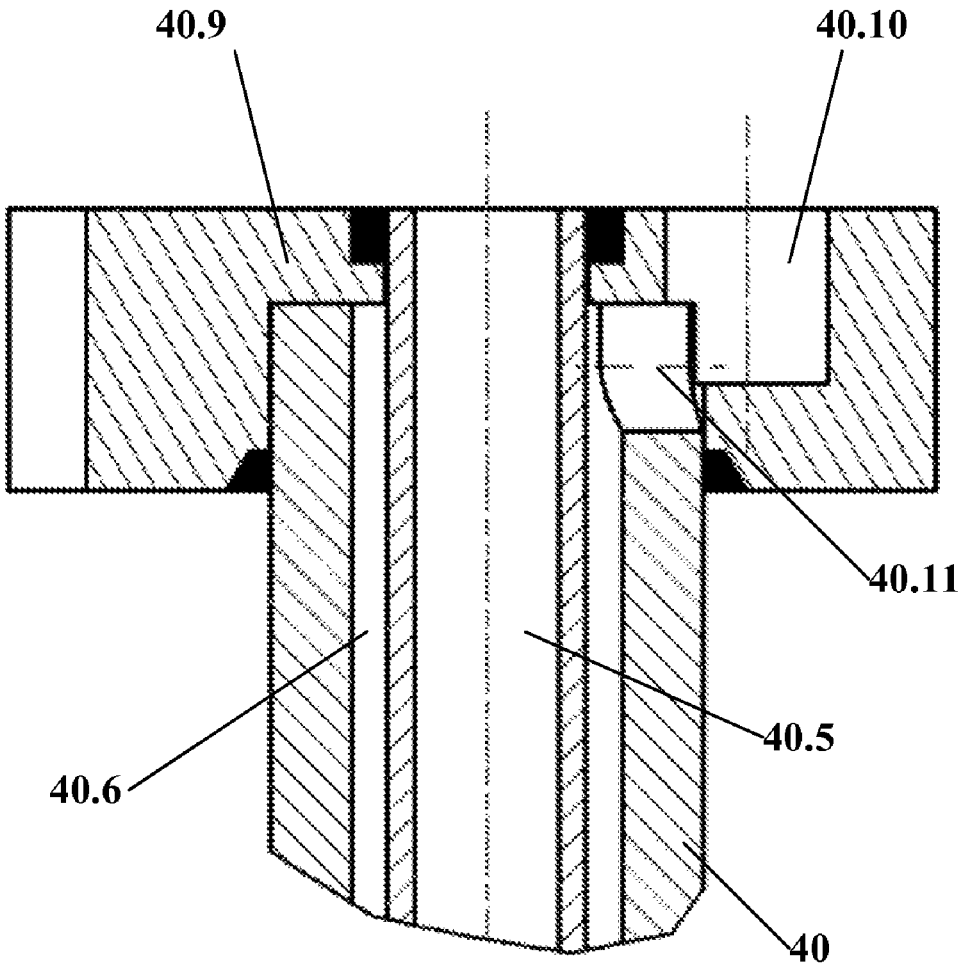
FIG. 27 illustrates a partial cross section through the end of the first stage feed piston rod showing the termination of concentric ports.

The piston rod 40 connects to the under surface of the lower plate 302, by means of a termination 40.9 which is illustrated in FIG. 27. The termination 40.9 allows the passage 40.5 to pass through the termination 40.9, while an outer concentric passage 40.6 includes a cut out or notch 40.11 through the outer wall of the piston rod 40 to allow the passage 40.6 access to port 40.10, which is offset from the passage 40.5 termination. This simplifies the porting of the A and B lines created by the passages 40.5 and 40.6 which pass through to the second stage feed cylinder 501 on the feed frame 14.

Figure 2:
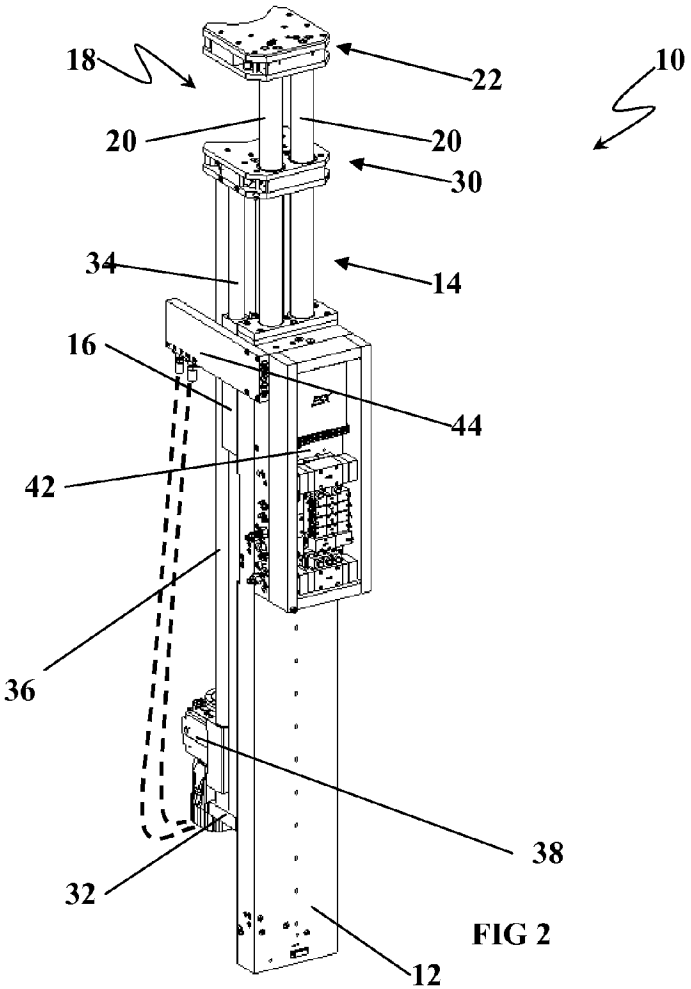
FIG. 2 illustrates a rear perspective view of the apparatus of FIG. 1.

The upper plate assembly 30 includes a pair of apertures 316 in top plate 312, a pair of apertures 318 in bottom plate 302, and apertures 322 through the body 320 of the location mechanism 310. When the body 320 of the location mechanism 310 and the plates 302 and 312 are aligned each of the respective apertures 318, 322 and 316 are coaxial so that the timber jack piston rods 20 can pass through the apertures as illustrated in FIGS. 1 and 2.

A bearing 324 and a wiper 326 are provided so as to sit within the aperture 316 of top plate of 312, while a bearing and wiper 321 is provided in the aperture 322 in mechanism body 320. The bearings can be slide bearings of the bronze ring type or any suitable slide bearing that the piston rods 20 of the timber jack 18 can pass through to minimise wear. The aperture 318 is dimensioned to provide clearance between the aperture 318 and piston rod 20.

When the plate assembly 30 is assembled the footprint of plate 312 overlies the footprint of the plate 302. It will be noted from FIGS. 3 and 4 that the plates 312 and 302 have sides 328 which angle in from the outer side edges towards the centre. Centrally located on the plates 312 and 302 is a recess or concave portion 330 made up of two straight sided sections 332 and a radiused centre section 334. The function of this concave portion 330 will be described in more detail below.

Figure 5:
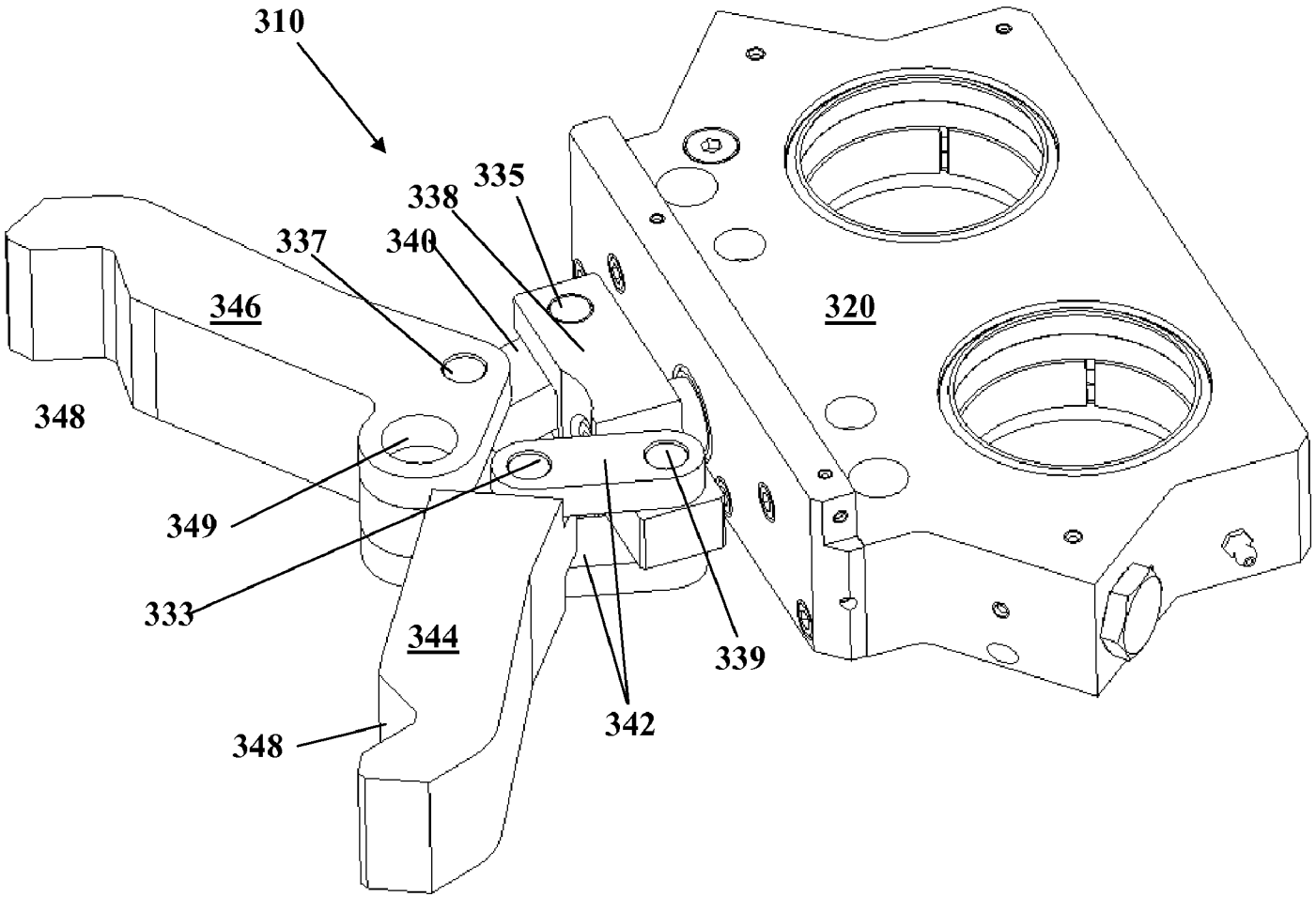
FIG. 5 illustrates the arm and jaw mechanism from the upper plate assembly of FIG. 3 with top and bottom plates removed.

As can be seen from FIG. 4 the body 320 of the location mechanism 310 houses a single centrally located piston 336.1 which moves inside a grip cylinder 336. The piston 336.1 terminates with a bolted on cross piece 338 which is pivotally connected by linkages 340 and 342 to respective arms 344 and 346. Linkage 342 is an assembly of two same sized links which attach to opposite sides of the cross piece 338 and arm 346 by pins 331 and 333. The two links together allow the linkage 342 to act as a double yoke. While the linkage 340 is made from a single link which connects to the arm 344 and cross piece 338 by pins 335 and 337. In this linkage 340, the arm 344 and cross piece 338 each have a yoke as is illustrated in FIG. 5. The linkage 340 and linkage 342 are used so that a balanced force is transmitted from cross piece 338 to arms 344 and 346 thereby preventing bending movements being applied to respective pivot pins. The arms 344 and 346 are generally dog legged or L-shaped and are in turn mounted for pivoting on pivot 349 which is secured between the plates 302 and 312. The arms 344 and 346, as best seen in FIG. 4 and FIG. 3, include a gripping portion 348.

As can be seen from FIG. 4 when the piston 336.1 in grip cylinder 336 is fully retracted, the arms 344 and 346 and the gripping portions 348 are completely within the footprint of the plates 312 and 302. The arms 344 and 346 are pivoted to the gripping and or locating position in an arcuate path, by means of the piston 336.1 pushing the piston rod 336.2 away from the grip cylinder 336 at bottom of the page of FIG. 4. When the arms 344 and 346 are extended, the space previously occupied by the arms 344 and 346 in the plate assembly 30 is now liable to be filled up with debris during the bolting operation. Accordingly, the elongated apertures 308 are present so that as the arms 344 and 346 are retracted back to within the foot print of the plates 312 and 302, the rear face of the arms 344 and 346 will help to force debris over the apertures 308, whereby they can fall through under the influence of gravity. Any debris present near the distal ends of the arms 344 and 346 will simply pass out of the plate assembly 30 in the unobstructed region of the tapered sides 328. Without the apertures 308 being present the central portions of the arms 344 and 346 would otherwise attempt to compress such debris against the tapered faces 350 of the valve blocks 352 and 354.

The apertures 308 are also useful in view of a relatively large amount of water that may fall from the drilling operations, so that any debris that would have otherwise have gathered, may flow with the drilling water which passes down and out of the plate assembly 30 through the holes 308 during the drilling operation.

Figure 7:
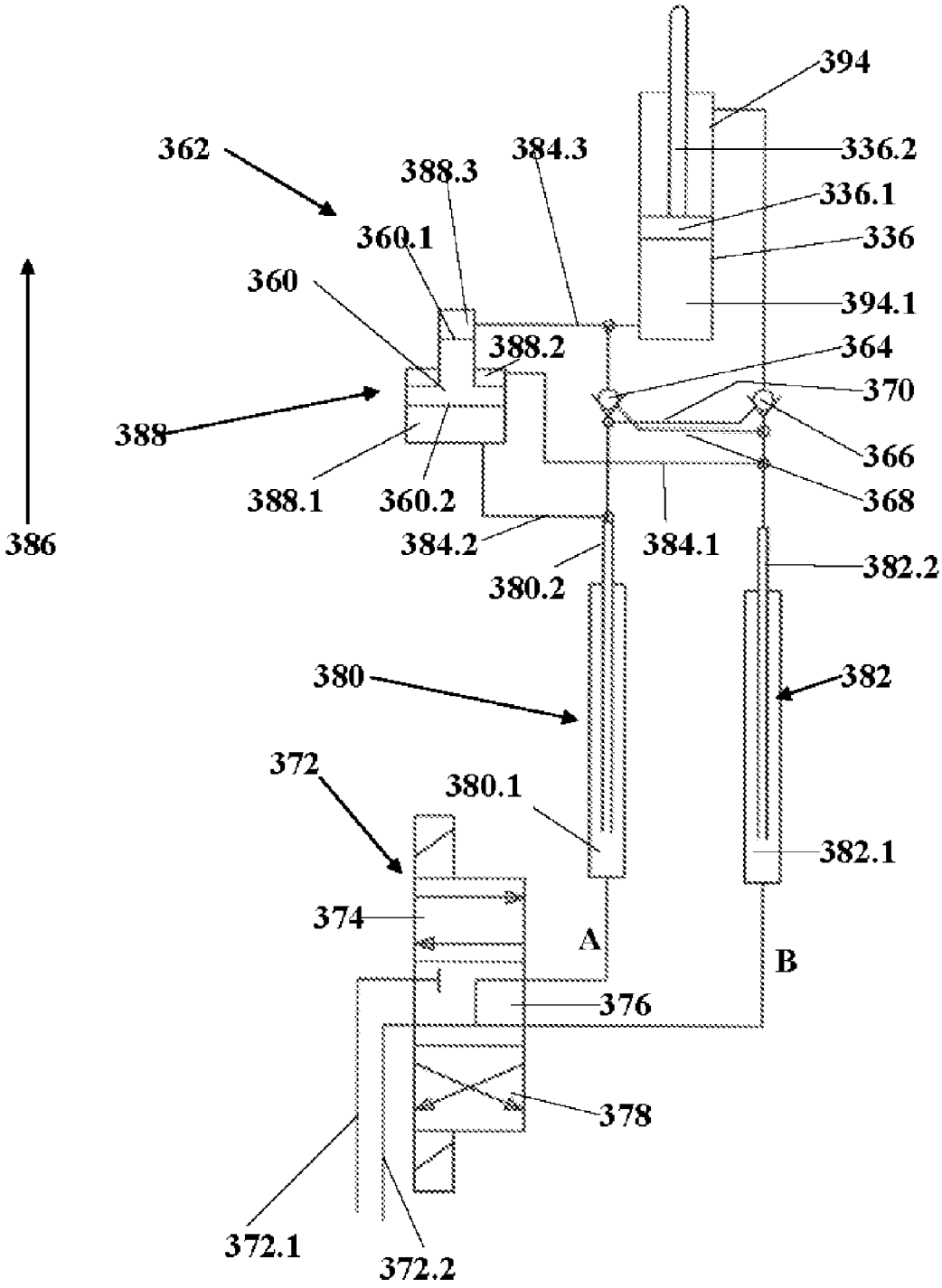
FIG. 7 illustrates a hydraulic circuit diagram of a relaxer unit used in the apparatus of previous Figures.

The location mechanism 310 includes in its hydraulic circuit 362 a relaxing mechanism 388 which is illustrated in FIG. 7, whereby the location mechanism 310 can serve the dual function of immobilising a rod and or locating a rod with rotational and or translational movement permitted. The relaxing mechanism 388 is formed in circuit 362 and comprises a relaxing piston 360 which has a small surface area piston 360.1 at one end and a larger surface area piston 360.2 at the other end. The relaxing piston 360 is able to slide in a body having three chambers 388.1 and 388.2 which have the piston 360.2 sliding therein, and chamber 388.3 which has piston 360.1 sliding therein. The chamber 388.3 is connected by a line 384.3 to the hydraulic line between a check valve 364 and the extension chamber 394.1 of the grip cylinder 336. The chamber 388.2 is connected by a line 384.1 to the hydraulic line between the plate assembly 30 end of the trombone slide 382.2 and the start of a cross link 368 which starts below a check valve 366. The chamber 388.1 is connected by a line 384.2 to a location between the plate assembly end of the trombone slide 380.2 and the start of a cross link 370 which starts below a check valve 364. The check valve 364 on an A line which when pressurised will pressurise the extension chamber 394.1 causing piston 336.1 to move in the grip cylinder 336 and piston rod 336.2 to extend from grip cylinder 336, while check valve 366 is on a B line which when pressurised will pressurise the retraction chamber 394 causing piston 336.1 to move in the opposite direction in grip cylinder 336 and the piston rod 336.2 to retract towards or into the grip cylinder 336. When the A line is pressurised the B line will be allowed to drain to a hydraulic fluid reservoir or tank and when the B line is pressurised the A line is allowed to drain to a hydraulic fluid reservoir or tank. This is achievers by means of the check valves 364 and 366 and the respective cross link 368 from the B line to the check valve 364 and cross link 370 from the A line to check value 366. The cross links 368 and 370 ensure that the respective check valves 364 and 366 will open to allow draining when chambers 394 and 394.1 respectively are pressurised.

The check valves 364 and 366 also serve the function of eliminating a pumping effect which results from the sliding, both inwardly and outwardly, of the trombones 380 and 382, with respect to their reservoirs 380. 1 and 382.1.

The volume of the chamber 388.3 which has the small surface area piston 360.1 sliding therein, controls the amount of release of the jaws 348 on arms 344 and 346. The volume of the chamber is calculated by this release amount. Thus if the arms 344 and 346 are to provide say 1 mm or 2 mm clearance of the outer diameter of the rod 110, then the change in volume required by the grip cylinder 336 is then calculated, and the chamber 388.3 made to this volume.

When the grip cylinder 336 is activated so that the arms 344 and 346 will grip a rod or locate a rod, pressurised hydraulic fluid is forced up through the A line through a three position control valve 372 having positions 374, 376 and 378 and through trombone passages 380 and 382 which will be described in more detail later. When position 374 of valve 372 is in line with the A and B lines, a source 372.1 of hydraulic pressure and access 372.2 to a hydraulic fluid reservoir or tank is connected respectively to the A and B lines. In this instance hydraulic fluid travels up the A line opening check valves 366 and 364 as well as forcing relaxing piston 360 to minimise the volume to chamber 388.3 by moving the piston 360.1 as far as possible in the direction of arrow 386 whilst also moving the piston 336.1 in the same direction. The relaxing piston 360 moves in this direction due to an equal pressure being applied in both chambers 388.1 and 388.3. The equal pressure results in a net force in direction 386 due to the larger surface area of piston 360.2 compared to smaller surface area of the piston 360.1. Once piston 336.1 has gone to it's fullest extent by keeping the control valve in the position 374, the drilling rod or roof bolt or roof bolt with drilling tip, is gripped and prevented from translation or rotation by jaws 348 on arms 344 and 346 thereby clamping the rod. By maintaining the valve 372 so that position 374 is operable, the rod will be immobilised by the location mechanism 310.

By moving the control valve 372 to the central position 376 as illustrated in FIG. 7, this will activate or close the check valve 364 and 366 thereby isolating or closing off the chambers 394 and 394.1 of the grip cylinder 336 and chamber 388.3 while maintaining the pressure therein. It will also allow the A line to drain via the trombone 380 back to a reservoir tank. Once this happens the pressure on the larger surface area piston 360.2 will be less than the pressure in the chamber 388.3 ultimately creating a net force on relaxing piston 360 in a direction opposite to arrow 386, forcing the relaxing piston 360 to move in the direction opposite to the arrow 386 whereby the volume of the chamber 388.3 increases allowing a predetermined relaxation of the pressure in the isolated circuit which would otherwise be making the grip cylinder 336 immobilise the rod.

When position 378 is selected on the valve 372, pressurised hydraulic fluid will flow through the trombone 382 and into the chamber 388.2 as well as opening check valves 364 and 366 pressurising the retraction chamber 394 which forces the piston 336.1 and piston rod 336.2 in the direction opposite to the arrow 386 thereby fully retracting the arms 346 and 344 within the foot prints of the plates 312 and 302 as illustrated in FIG. 4.

The relaxing circuit 362 allows the arms 344 and 346 and the jaws 348 to have the dual function of both immobilising the rods to prevent rotation and translation when valve 372 is in position 374 or when in the neutral position of 376 to maintain sufficient pressure on the arms 344 and 346 to act as a locator without applying pressure on the rod held between the jaws 348 thereby allowing translation of the rod relative to the jaws 348 and rotation relative thereto as well.

The concave portion 330 co-operates with the arms 344 and 346 and the jaws 348 to maintain a rod (drill rod or roof bolt or combination thereof) a predetermined distance away from the walls 332 and 334 which form the concave portion 330. This predetermined distance is sufficient to allow clearance for a circular washer plate of 172 mm or 6.8 inch diameter making approximately 86 mm or 3.4 inches from the centre to the outside circumference. The concave portion 330 as formed by its straight sides 332 and radius 334 is shaped and dimensioned so as to permit this passage.

The concave portion 330 could generally be described as being boomerang shaped or a V shape with a radius centre. The concave portion 330 ensures that the arms 344 and 346 do not have to be retracted back through 90° relative the rear side of the plate assembly 30 thus ensuring that the arms 344 and 346 travel through an optimum distance to re-acquire a rod between the jaws 348.

The relaxing mechanism 388 is preferably located in the plate assembly 30 however it will be readily understood that it could be located elsewhere. The relaxing mechanism 388 could be located in another portion of the rig away from the plate assembly 30, such as in the valve block 42, but such a location will need to be consistent with the requirement to interact or cooperate with the check valves 364 and 366.

Figure 8:
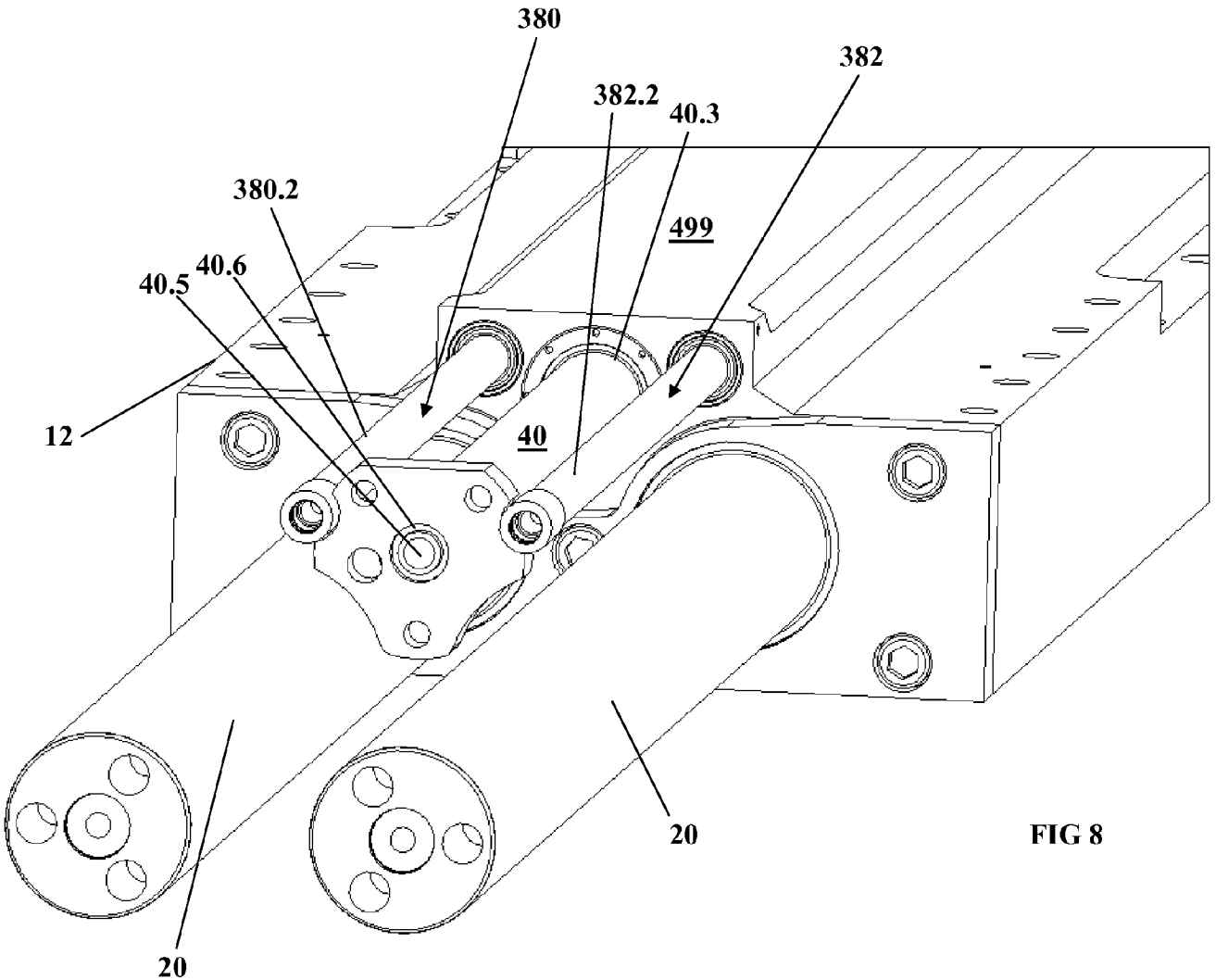
FIG. 8 illustrates a perspective view of the top of the base of the rig of FIG. 1 with the feed frame and plate assembly of the timber jack removed.
Figure 9:
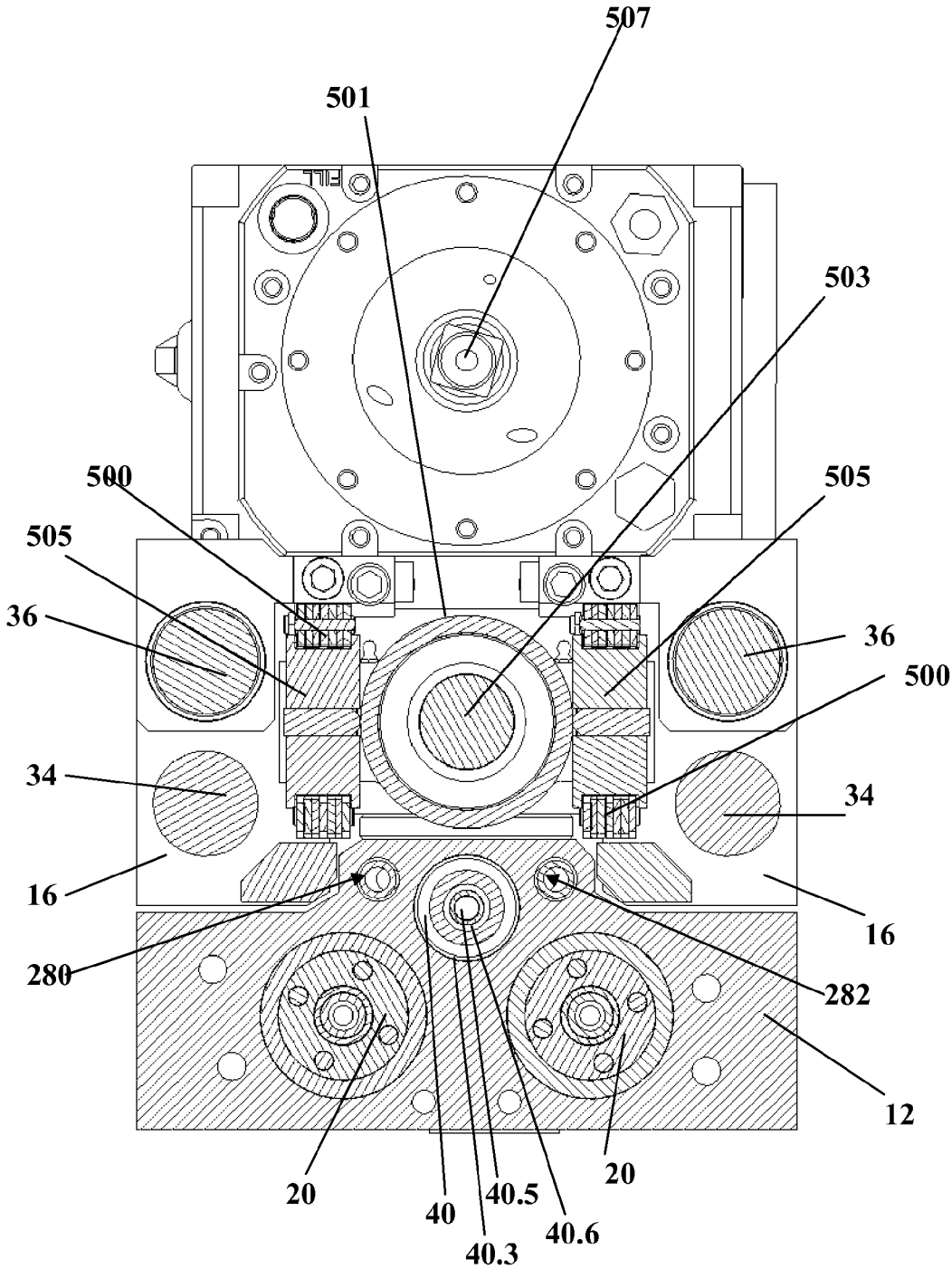
FIG. 9 illustrates a cross section through the base and feed frame with the rotation unit unsectioned.

The plate assembly 30 captures the timber jack piston rods 20, as illustrated in FIG. 8, which slide through the plate assembly 30, however the first stage feed movement of the feed frame 14 is performed by the piston rod 40 which slides into and out of the base 12. As can be seen schematically in FIG. 7, the two trombones 380 and 382 can be clearly seen in FIG. 8. These trombones 380 and 382 are slide tubes which slide into and out of reservoirs 380.1 and 382.1 respectively which are located inside the base 12. The slide tubes 380.2 and 382.2 pass through the plate 302 and connect to the mechanism body 320 via the plate 302 and are there secured for communicable passage of hydraulic fluid to the location mechanism 310 by means of banjo bolts or similar bolting systems which allow hydraulic connection to as well as securement. Thus as the feed frame 14, with its first and second feed frame members 34 and 36, moves relative to the base 12, the plate assembly 30 is also moving therewith and thus the location mechanism 310 is obtaining a source of pressurised hydraulic fluid from the trombone slide tubes 380.2 and 382.2. Through the centre of the piston rod 40 are concentric A and B ports 40.5 and 40.6 which provides a source of hydraulic fluid and a return line for the second stage feed cylinder 501 which is mounted on the feed frame 14, as described below in relation to FIG. 26.

Figure 11:
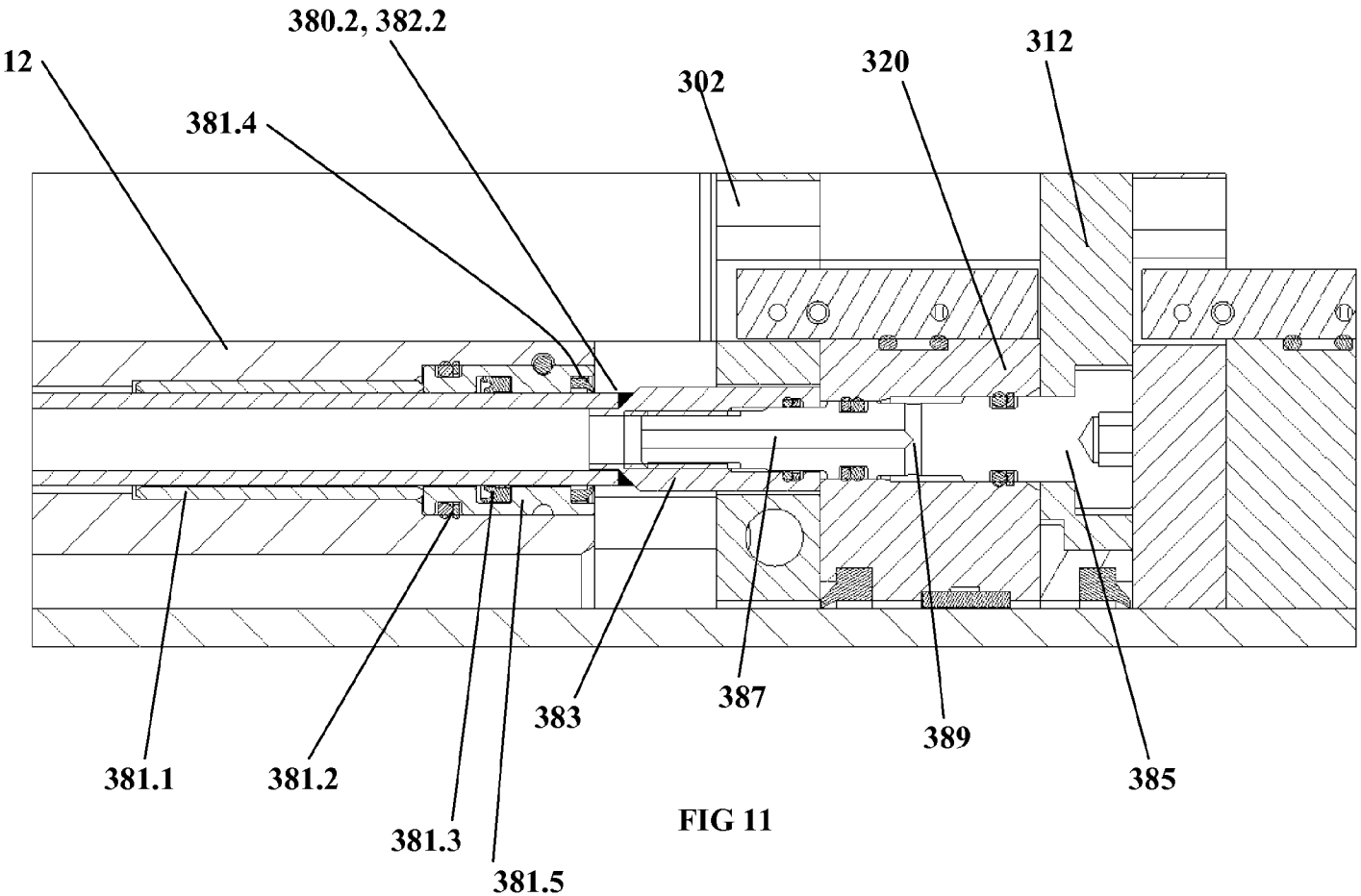
FIG. 11 illustrates a cross section through the plate assembly showing the connection of the sliding tubes to the plate assembly.

As is illustrated in FIG. 11, the threaded ends 383 of the trombone sliding tubes 380.2 and 382.2 are secured by a banjo bolt 385 the head of which will contact the upper plate 312 securing the terminus of the tubes 380.2 and 382.2 against the mechanism block 320. The longitudinal aperture 387 and lateral aperture 389 through the banjo bolt 385 gives the centre of the tubes 380.2 and 382.2 access to the hydraulic passages in the mechanism block 320. Appropriate seals are also provided.

The threaded ends 383 are formed by welding a threaded union to the end of the trombone sliding tubes 380.2 and 382.2. The trombone sliding tubes 380.2 and 382.2 in passing out of the base 12 are assisted in their movement by a journal bearing 381.1 which sits internally of a seal and wiper block 381.5 which houses seals 381.2 and 381.3 and a sliding/wiping seal 381.4.

As can be seen from FIG. 8 the base 12 has a generally T shaped cross section whereby the central portion 499 in which is located the piston rod 40 and the trombone arrangements 380 and 382, extends along the whole length of the base 12. The central portion is proud of the surfaces 502 on the base 12.

Figure 10:
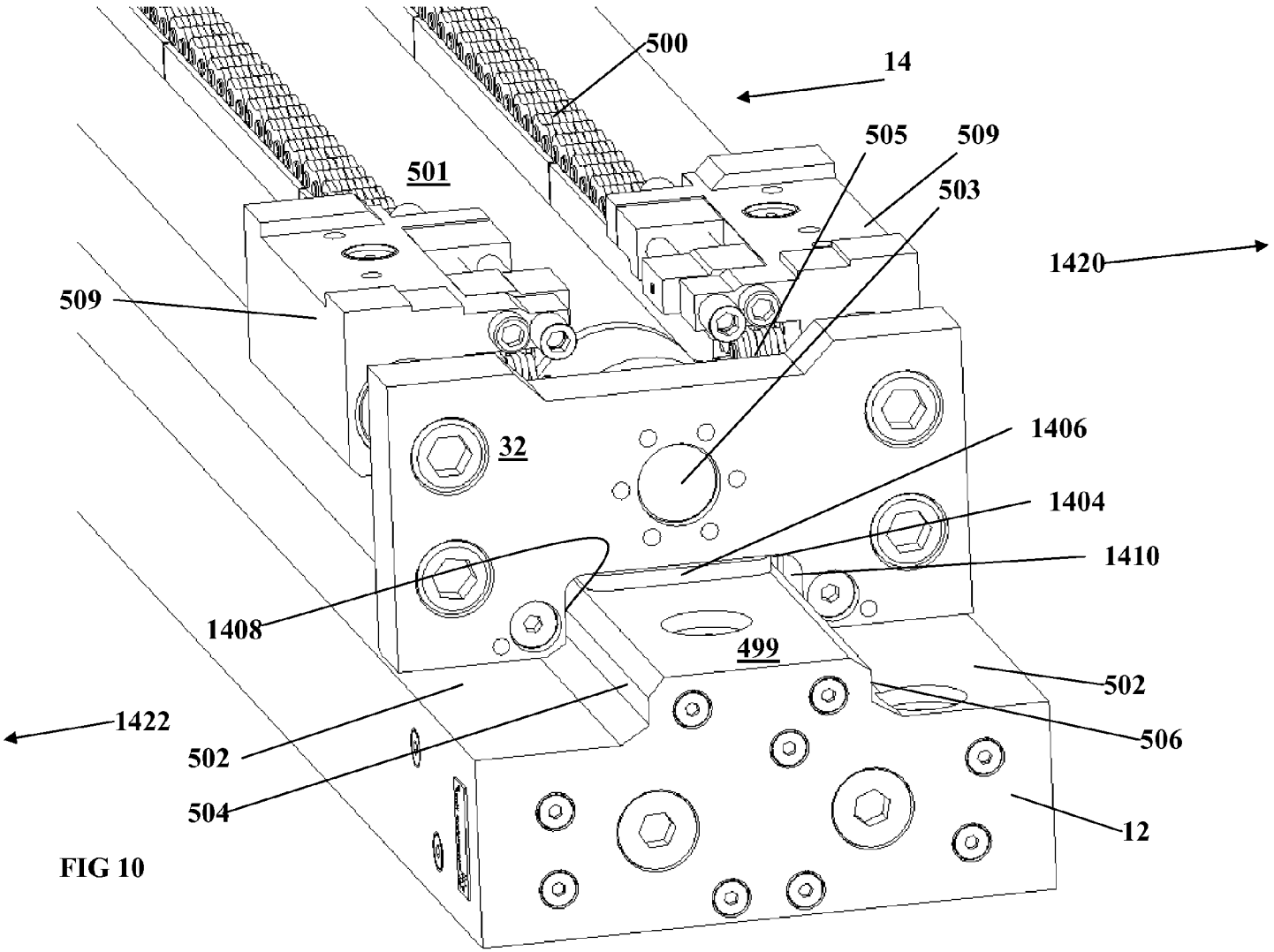
FIG. 10 illustrates a perspective view from underneath the rig of FIG. 1 showing the bottom plate of the feed frame and how it interacts with the base of the rig.

As is illustrated in FIG. 10, the base plate 32 of the feed frame 14 has a corresponding cut-out or U-shaped recess 1404 in which can be received the proud central portion 499 of the base 12. The cut out 1404 includes a bearing plate 1406 secured therein so that the bearing plate 1406 can slide along the surface of the central portion 499. The U-shape recess 1404, by straddling the central portion 499, provides a lateral bearing face 1408 and 1410 to bear against the sides 504 and 506 respectively on the base 12. The faces 1408 and 504 and 1410 and 506 help to ensure that the feed frame will not rotate in the directions of arrows 1420 or 1422 relative to the base 12 when in operation.

Figure 26:
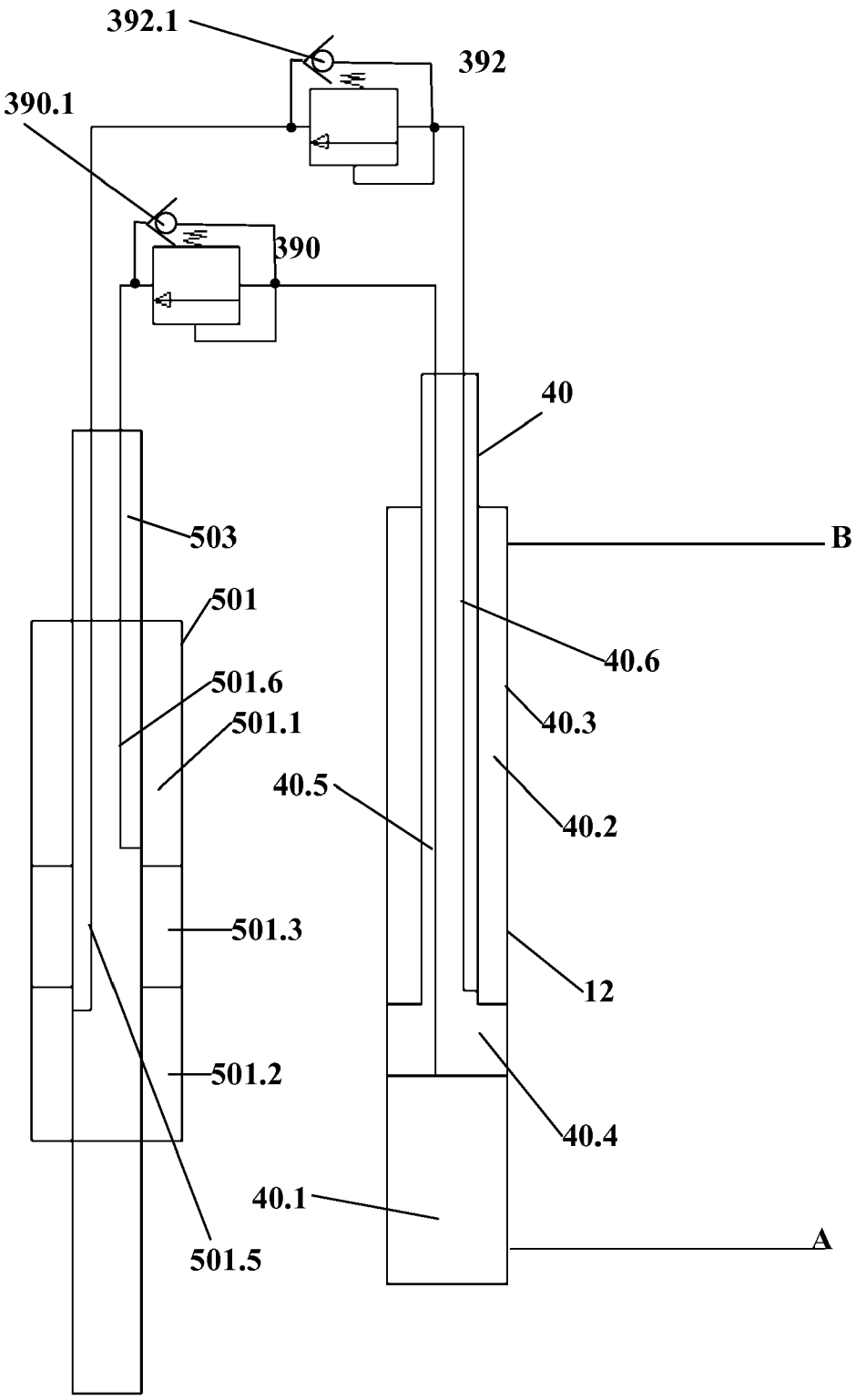
FIG. 26 illustrates an hydraulic circuit diagram of the upper plate assembly showing of the sequencer valves in the circuit.

The valve blocks 352 and 354 house sequencer valves 392 and 390. The sequencer valves 390 and 392, as illustrated in FIG. 26, operate respectively with the first stage of movement of the feed frame 14 relative to the base 12 provided by means of piston rod 40, and with the second stage of movement of the rotation unit 38 relative to feed frame 14 provided by the cylinder 501. The sequencer valves 390 and 392 will ensure that the second stage of movement will not occur until the feed frame 14 is moved to its uppermost location or alternatively the pressure in the first stage has acquired a predetermined magnitude, whereupon the second stage will be operable. Further the second stage will not be able to retract until the first stage has been retracted, or until the pressure in the retraction circuit has acquired a predetermined magnitude. This sequencing assists with the automation process, so that sensors and control circuitry are able to determine the condition of components before moving on to the next desired condition.

As illustrated in FIG. 26 the piston rod 40 moves into and out of a cylinder 40.3 in the base 12. The cylinder 40.3 has effectively two chambers being an extension chamber 40.1 and a retraction chamber 40.2 whereby pressurising chamber 40.1 causes extension of the piston rod 40 connected to piston 40.4 out of the base 12, while pressurising chamber 40.2 causes the piston rod 40 and piston 40.4 to retract back into the base 12.

When chamber 40.1 is pressurised to a sufficient extent by incoming fluid and pressure through the A line, indicating that the piston rod 40 has moved to its maximum travel either allowed in a mine entry or by the feed frame 14 moving its maximum travel relative to the base 12, then the sequence valve 390 will open, by means of pressure through passage 40.5, against its bias to be closed, allowing fluid from passage 40.5 to enter passage 501.6 to activate second stage cylinder 501, by pressurising chamber 501.1. This in turn allows hydraulic fluid to drain via line 501.5 through the check valve 392.1 and into passage 40.6 to drain via chamber 40.2 and out the B line of FIG. 26.

The cylinder 501 has an extension chamber 501.1 which when pressurised will force the cylinder 501 upwards and by means of the chain drive 500, chain pulleys 505 and the anchors provided by chain securing member 306, will move the rotation unit 38 along the feed frame 14 in an extending manner towards the plate assembly 30.

To pressurise the retraction chamber 501.2 so as to make the cylinder 501 retract, pressure will enter through the B line forcing the piston 40.4 and piston rod 40 back into the cylinder 40.3 and thus the base 12, whereupon sufficient pressure will, via passage 40.6, open the sequencer valve 392 and via passage 501.5 will pressurise retraction chamber 501.2. In this case the fluid in extension chamber 501.1 will drain via passage 501.6 past check valve 390.1 and into passage 40.5 to drain via chamber 40.1 to the A line. This will retract the rotation unit 38 away from the plate assembly 30 of the feed frame 14.

The passages 40.5 and 40.6 in the piston rod 40 are concentrically arranged through the piston rod 40 so as to optimise the cross sectional area thereof. Whereas the passages 501.5 and 501.6 are adjacent passages through the piston rod 503, as the piston rod 503 is of a larger diameter than the piston rod 40. The piston rod 503 has one end secured to bottom of the plate assembly 30 and the other end to the lower plate 32 of the feed frame 14.

As can be seen from FIG. 26, until the chamber 40.1 is pressurised chamber 501.1 cannot be pressurised, and until chamber 40.2 is pressurised then chamber 501.2 cannot be pressurised. By this means the sequencing mentioned in previous paragraphs will occur.

Figure 13:
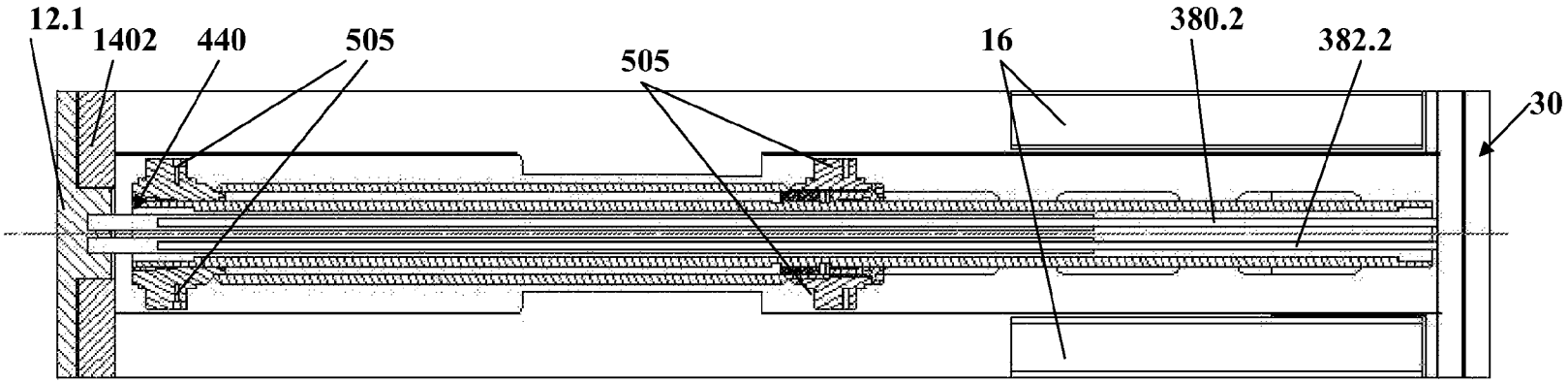
FIG. 13 illustrates schematic cross section through the foot and feed frame of the bolter of FIG. 12.
Figure 12:
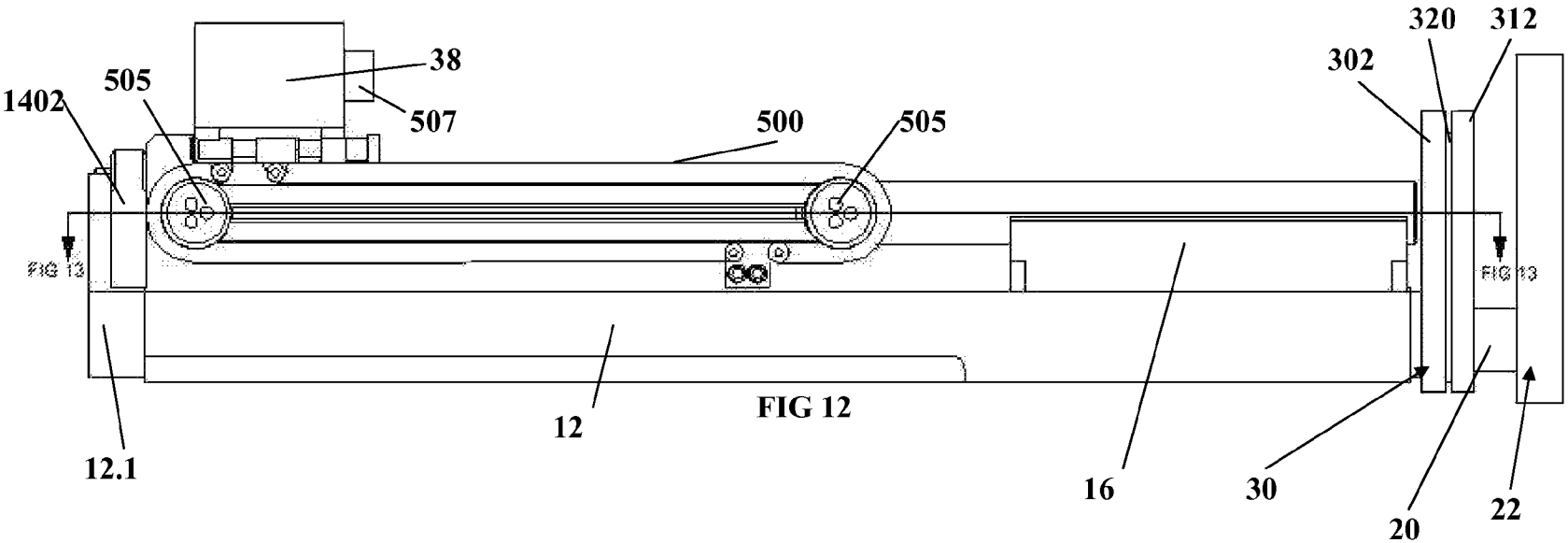
FIG. 12 illustrates schematically another bolter with a location system which receives motive power from a foot attached to said base.

The feed frame 14 of FIGS. 1 to 11 is provided with motive force by the piston rod 40 ejected from a cylinder which is in the base 12. This first stage of movement of the feed frame 14 could alternatively be done by the means described in U.S. Pat. No. 6,105,684, which is for convenience illustrated in FIG. 12 and 13. FIGS. 12 and 13 are modified FIGS. 19 and 20 from U.S. Pat. No. 6,105,684. FIGS. 12 and 13 do not show slide blocks and other components and are for illustrative purposes only whereby the plate assembly 30 receives motive power from the base plate 12.1 of the base 12 of the rig. The piston/rod 440, which is similar to the piston rod 40 of previous Figures in that it produces movement of the feed frame relative to the base 12, can then have internal trombones 380.2 and 382.2, which join to the plate assembly 30 in the same manner as discussed above with respect to FIG. 11.

Figure 6:
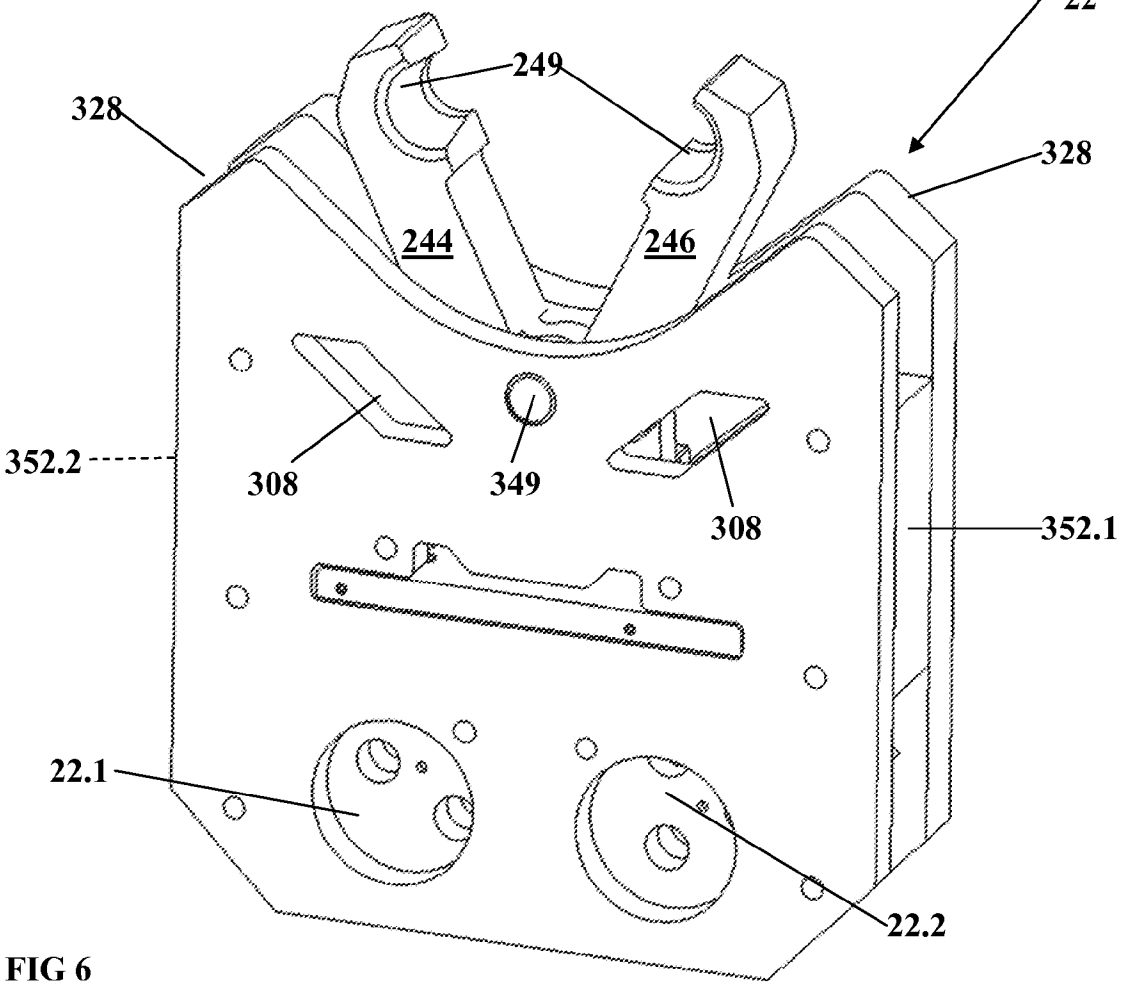
FIG. 6 illustrates the plate assembly of the timber jack viewed from the underside.

Illustrated in FIG. 6 is the plate assembly 22 which is secured to the distal ends of the timber jack piston rods 20, which are located in the circular recesses 22.1 and 22.2. The plate assembly 22 is similar in most respects to the plate assembly 30 described above and like parts have been like numbered. The plate assembly 22 differs from the plate assembly 30 in that the blocks 352.1 and 352.2 are only plain spacer blocks and not ported like the blocks 352 and 354 of FIGS. 3 and 4.

The plate assembly is connected to a source of hydraulic fluid by two trombone slides, which are associated with the timber jack piston rods 20. Preferably there is one trombone slide to each piston rod 20.

One difference between the plate assembly 22 and 30 is that the plate assembly 22 has its arms 244 and 246 each including semi conical jaw formation 249 which provides a converging and centering passage through the arms 244 and 246 when they are side by side.

The jaw formations 249 on arms 244 and 246 when side by side provide a minimum aperture which is larger than the diameter of the rods supplied to the rig 10. This is contrasted with the jaws 348 on arms 344 and 346 which are sized and shaped so that the rods used with the rig 10 can be gripped to prevent relative movement between the jaws 348 and the rod, and also sized and shaped so that they will provide sufficient clearance yet maintain their locating function when required.

As the plate assembly 22 only needs to perform a locating function, the hydraulic circuit to power the location mechanism 310 in the plate assembly 22 does not include a relaxer mechanism. In this circumstance the plate assembly 22 is set by means of the hydraulic circuit to apply sufficient pressure to centralise, but not immobilise a drill/and or rod.

The above describes the location mechanism 310 as being part of the plate assembly 30 and at the ends of the frame members of the feed frame 14 and captures the piston rods 20 of timber jack 18. In this location the feed frame provides a maximised travel distance for the rotation unit 38 along the second frame members. However it is possible to locate the location mechanism 310 at a different location on the feed frame, whereby the feed frame is held together by top and bottom plates and the location mechanism 310 is mounted via the top plate and or the second frame members to the feed frame 14, and without capturing the piston rods 20 of the timber jack 18. In either position, the location mechanism is still connected to the base 12 via the feed frame 14. It is also possible to obtain a few of the benefits of the invention by mounting the location mechanism directly on the base 12 (not shown). For example, in alternate embodiments (not shown), the location mechanism can be connected to the base 12 and pass through or around the feed frame 14.

Figure 14:
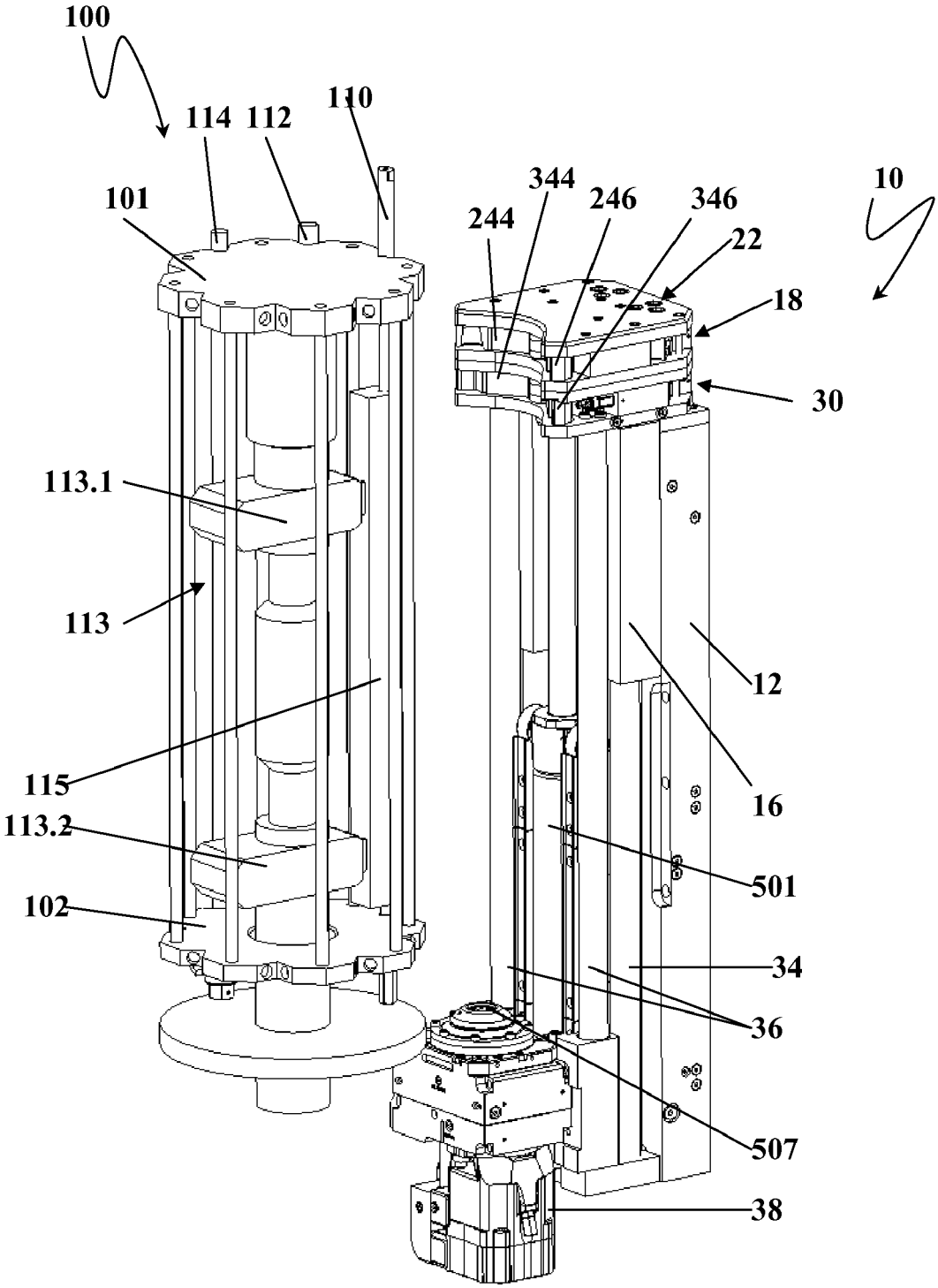
FIGS. 14 to 25 illustrate a series of perspective views of a bolting rig and associated carousel and the actions utilised to perform a bolting or drilling process (in all views a mine roof or wall is not illustrated and in some views the drill rod has been truncated for ease of illustration)

The drill rig 10 of the previous figures is illustrated in FIGS. 14 through to 25 showing a sequence of interactions with a carousel 100. These interactions when of an automatic nature are controlled by an automated control system. However, if desired the interactions and operations can be performed manually by an operator.

Thus in operation the drill rig 10 as in FIG. 14 can start in a fully contracted or collapsed tramming condition whereby the drill rig 10 and the carousel 100 have been moved by a mining vehicle such as bolter or a continuous miner or other implement, to which the bolting/drilling rig 10 has been attached, to an appropriate location in a mine entry so as to bolt a roof, or wall of the mine entry.

In a fully retracted condition the arms 344 and 346 on the plate assembly 30 which is on the feed frame 14 are in an open condition and the rotation unit 38 is at its lower most location, while the carousel 100 is located adjacent to the drill rig 10.

Figure 15:
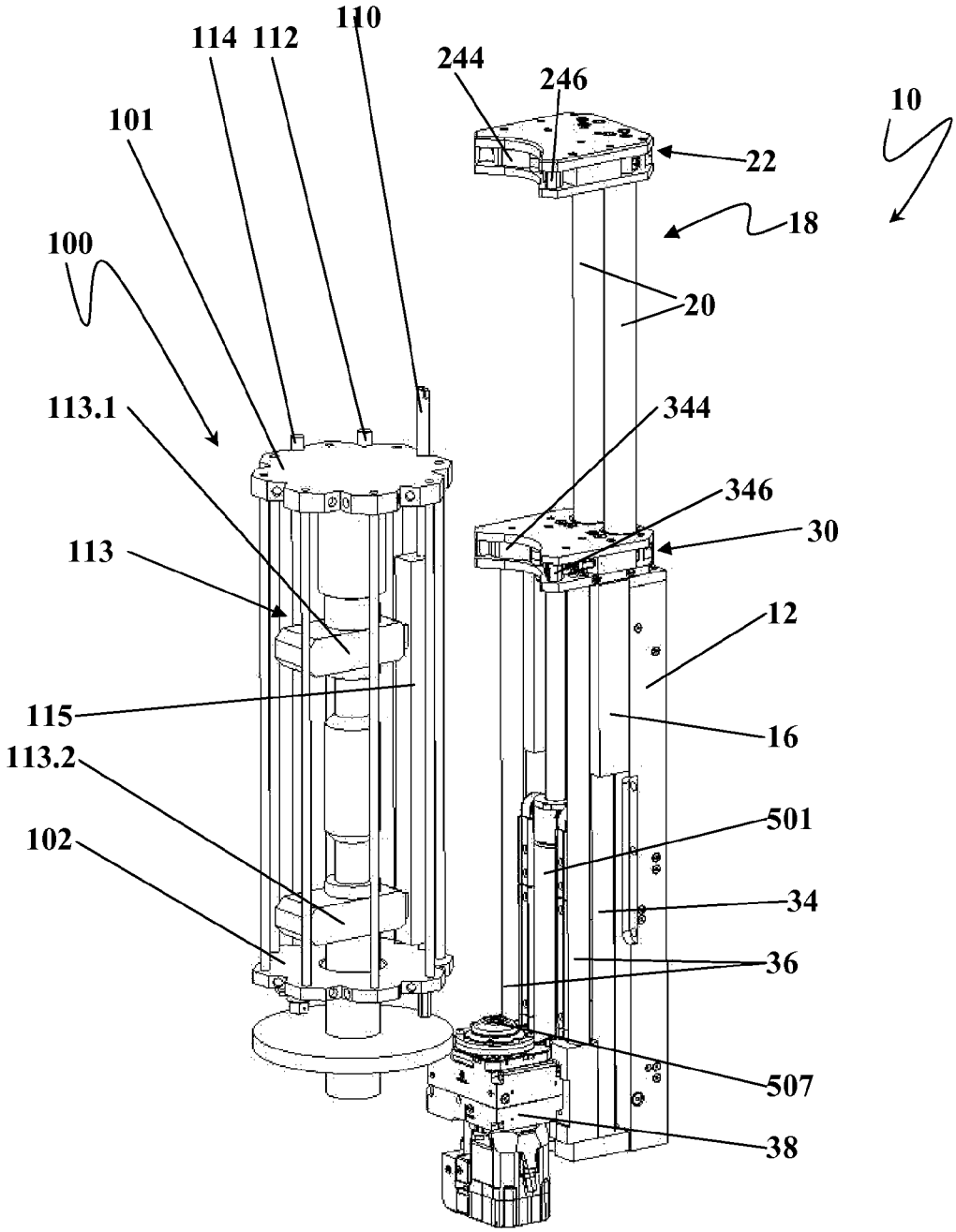

A bolting or drilling operation will usually begin by the timber jack 18 with plate assembly 22 at its top end being moved away from the base 12 as illustrated in FIG. 15. As this is happening the arms 344 and 346 on the plate assembly 30 are open, as are the arms 244 and 246 on the plate assembly 22.

Figure 16:
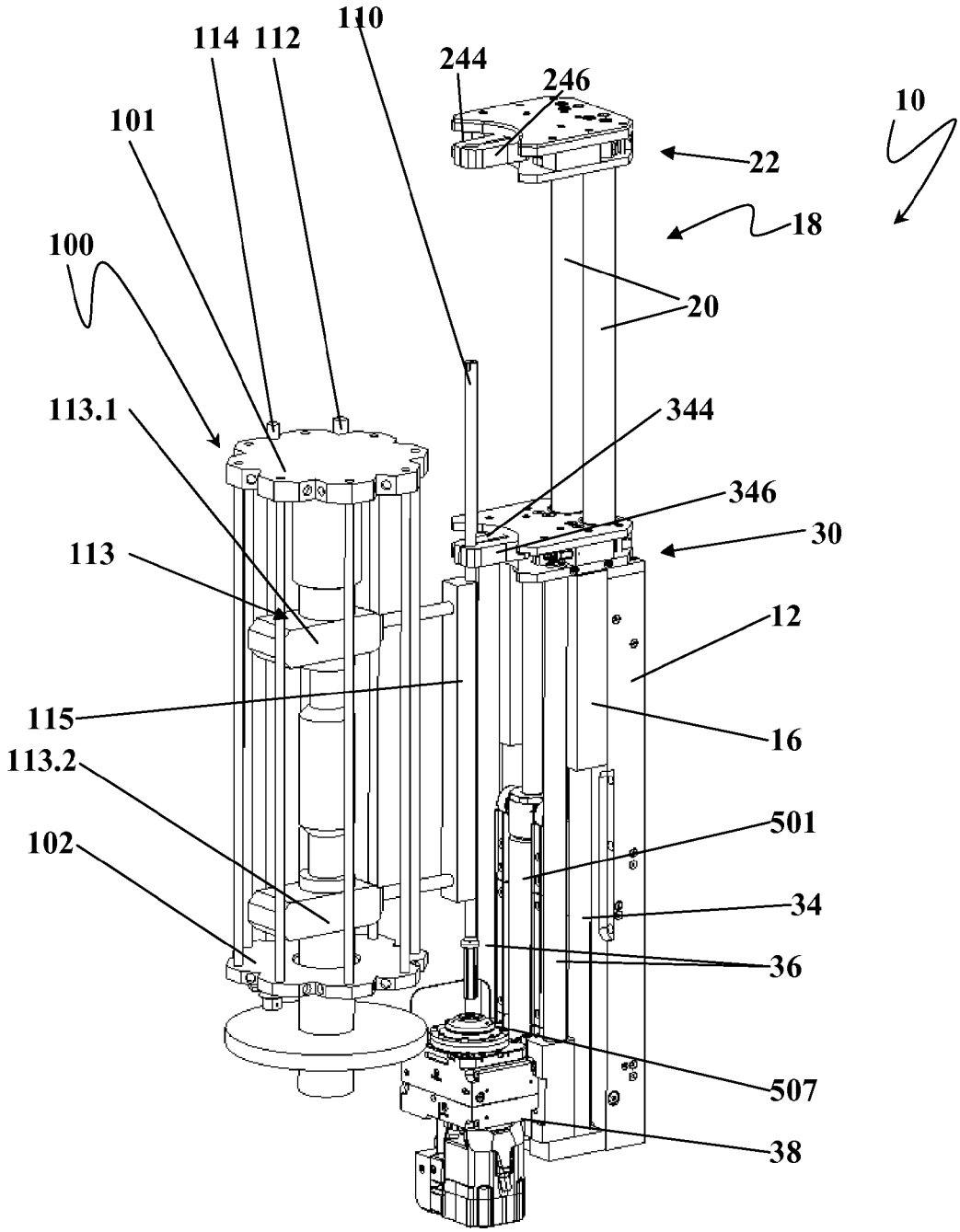

When the plate assembly 22 engages a mine floor, roof or wall, the arms 244 and 246 will close as illustrated in FIG. 16. This helps to keep the arms 244 and 246 protected as the plate assembly 22 moves and engages the mine roof or wall.

Simultaneously or sequentially with the extension of the timber jack 18 to engage the mine roof or wall, the carousel 100 has its carriage spiders 101 and 102 rotated until an appropriate drill rod 110 or roof bolt 112 or miscellaneous rod 114 (such as a steel tube with a chemical anchor therein) is aligned so that the rod can be transferred to the rotational axis of the rotation unit 38 of the rig 10. The carousel 100 is similar to those described and illustrated in U.S. Pat. Nos. 6,302,623 and 6,135,674, except that the upper section of the carousel illustrated in these patents is not utilised.

As illustrated in FIG. 16, in the next sequence a transfer mechanism 113 will come into operation. The transfer mechanism 113 comprises upper and lower hydraulic cylinders 113.1 and 1 13.2 respectively and a vertically oriented magnetic cradle 115 which is attached to each of the distal ends of the pistons rods emanating from the hydraulics cylinders 113.1 and 113.2. The spiders 101 and 102 have notches and magnetic, spring clip or other type of gripping holders associated with them so as to keep the rods firmly in position thereon. When the cradle 115 extends in a radially outward direction from the carousel 100 by the hydraulic cylinders 113.1 and 113.2 extending, the upper and lower spiders 101 and 102 will be made to release their grip on a rod 110, 112 or 114 thereby pushing the cradle 115 and rod towards the axis of rotation of the bolting rig 10.

In FIG. 16 the rod 110 is shown as having traversed the distance between the carousel 100 and the rig 10. The rod 110 is transferred to the rotation axis of the rotation unit 38, whereupon the arms 344 and 346 on the plate assembly 30 are closed and to locate the rod 110, but are not preventing relative movement of the rod 110 either axially or rotationally around the axis of the rod 110.

Figure 17:
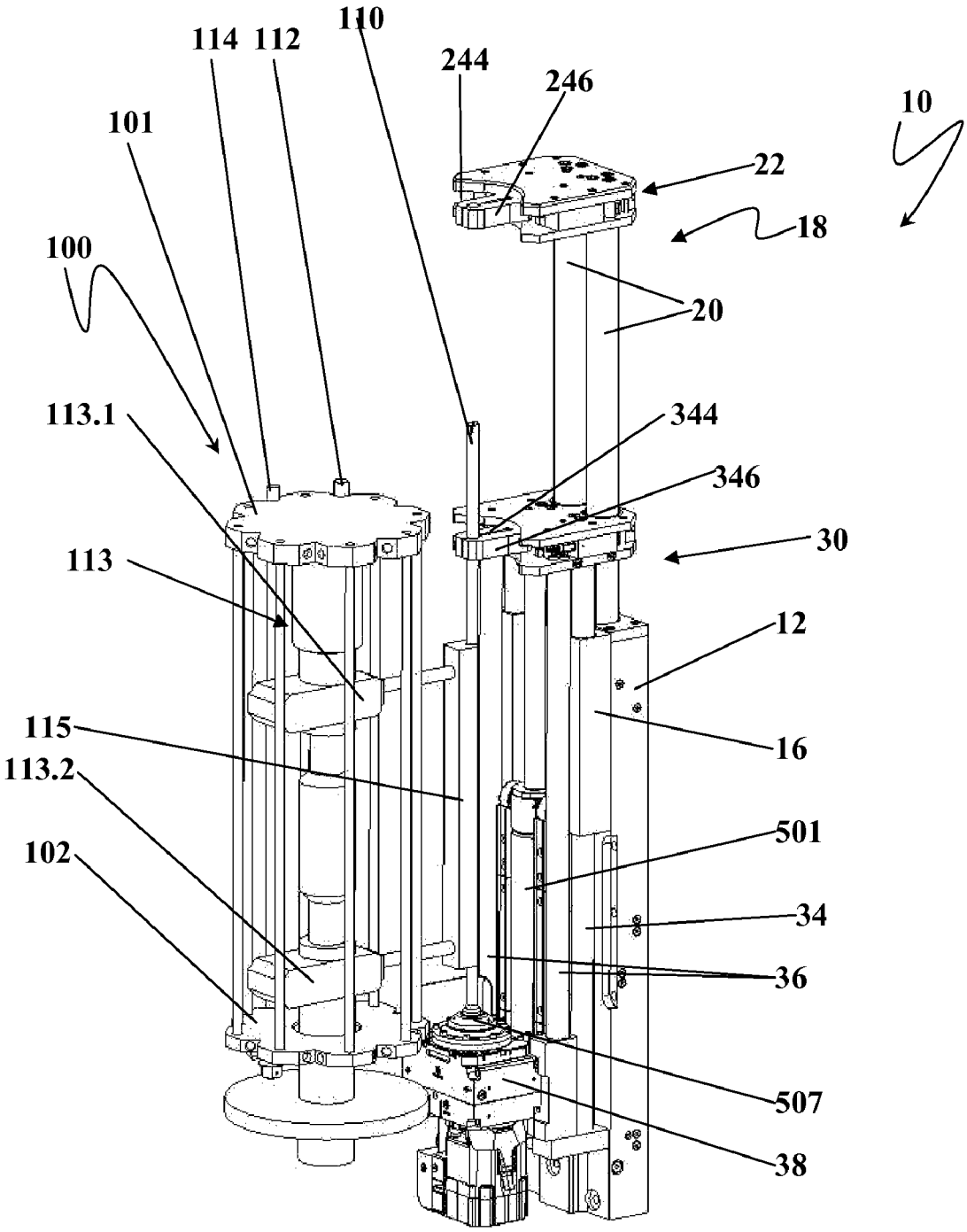

As illustrated in FIG. 17, either simultaneously with or sequentially of the jaws 348 on arms 344 and 346 having located the rod 110, the feed frame 14 and rotation unit 38 are moved in unison vertically relative to the base 12 and carousel 100, so that the drive on the rotation unit 38 will engage with the drive end of the rod 1 10. During this step the rotation unit 38 has its drive chuck rotating at a relatively low speed to assist the alignment and engagement with the drive end of the rod 110.

The drives on the rotation unit 38 may be one of several types. One type may be a twist locked drive whereby the drive end of the rod 110 would actually be locked onto the drive of the rotation unit 38. In this case, movement of the rod 110 in a retraction direction can be affected without reliance on friction and or gravity due to the interlinking provided by the twist lock drive. Another type of drive may be one in which a simple socket is provided, however such a socket will rely on friction and or gravity so that the rod 110 will retract direction when the rotation unit 38 is retracted.

By the arms 344 and 346 and the rotation unit 38 both engaging the rod 110 at respectively upper and lower points on the rod 110, the cradle 115 is able to retract towards the carousel 100 while leaving the rod 110 coaxial with the rotation axis of the rotation unit 38. By retracting towards the carousel 100, the magnetic force of attraction between the rod 110 and the cradle 115 will be broken. The cradle 115 is retracted all the way to within the footprint of the spiders 101 and 102 as is illustrated in FIG. 18.

Figure 18:
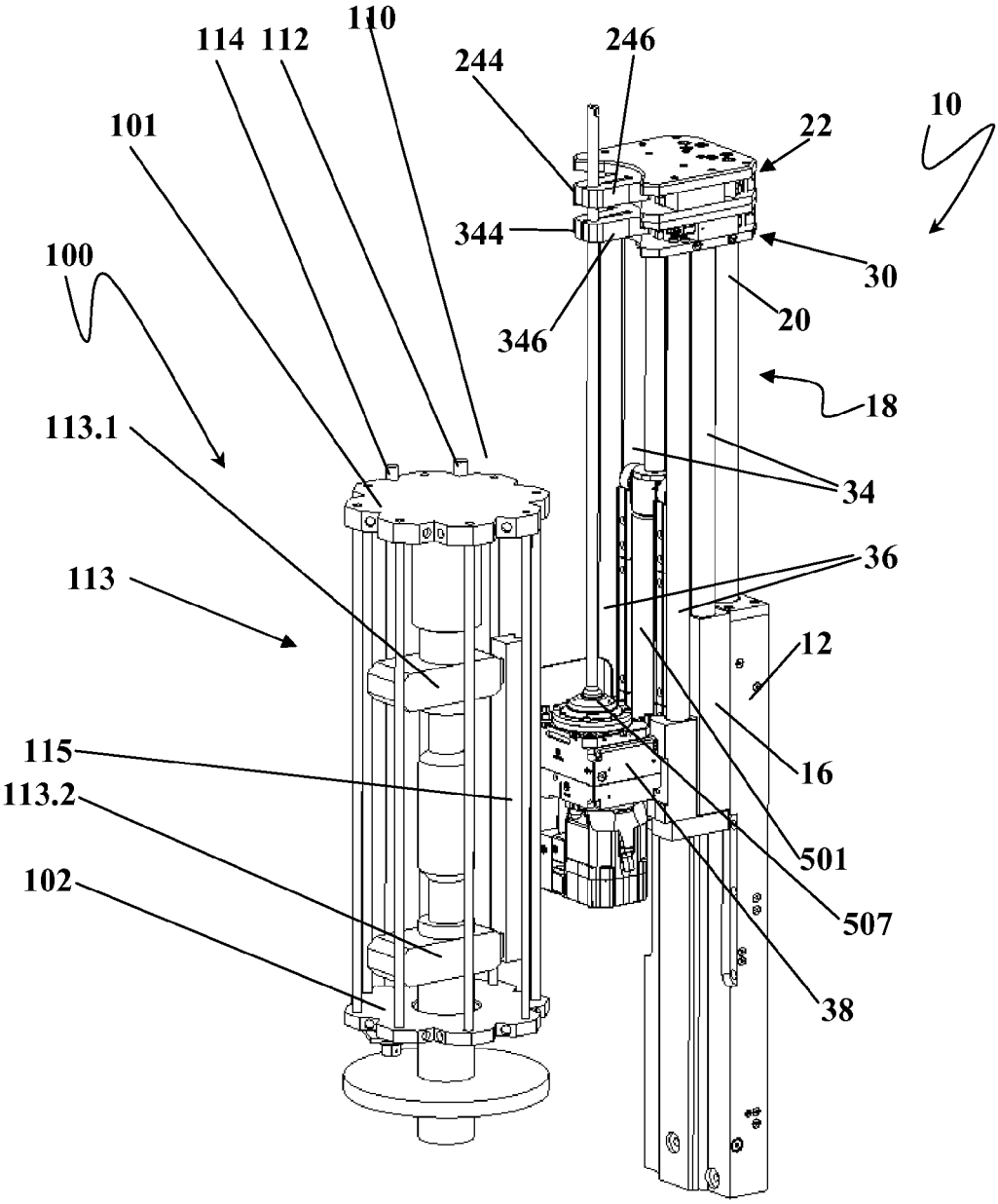

As illustrated in FIG. 18, the rotation unit 38 and the arms 344 and 346 of the upper plate assembly 30 are restraining the rod 110 at two locations. These locations are then moved in unison towards the plate assembly 22 whereby the rod 110 will pass through the tapered lead in formed by the conical jaws 249 on the arms 244 and 246 (as illustrated in FIG. 6) which serve a solely locating or centralizing function and not a gripping function. The arms 244 and 246 on the plate assembly 22 can alternatively be made to close around the drill rod 110 as the rod's tip passes the plate 22. When this happens the plate assembly 30 and its jaws 348 on arms 344 and 346 are still locating the drill rod 1 10. Rotation of the drill rod 110 may not be required until engagement with a mine floor, wall or roof occurs.

Illustrated in FIG. 18 the plate assembly 22 has located or centralized the rod 110 and the plate assembly 30 maintains a locating or centralizing role which allows the drill rod 110 to be rotated by the rotation unit 38.

The feed frame 14 will continue to move, by means of first stage cylinder 40.3 and piston rod 40, until the drill tip of the rod 110 engages the floor, roof or wall of the mine entry. When this happens the pressure in the first stage feed hydraulic circuit will increase. This increase in pressure or other means will trigger the rotation unit 38 to begin rotating the drill rod at drilling speed. Thus the first stage feed will move the rod into the mine roof or wall until the plate assembly 30 has engaged the under surface of the plate assembly 22, as is illustrated in FIG. 18.

Figure 19:
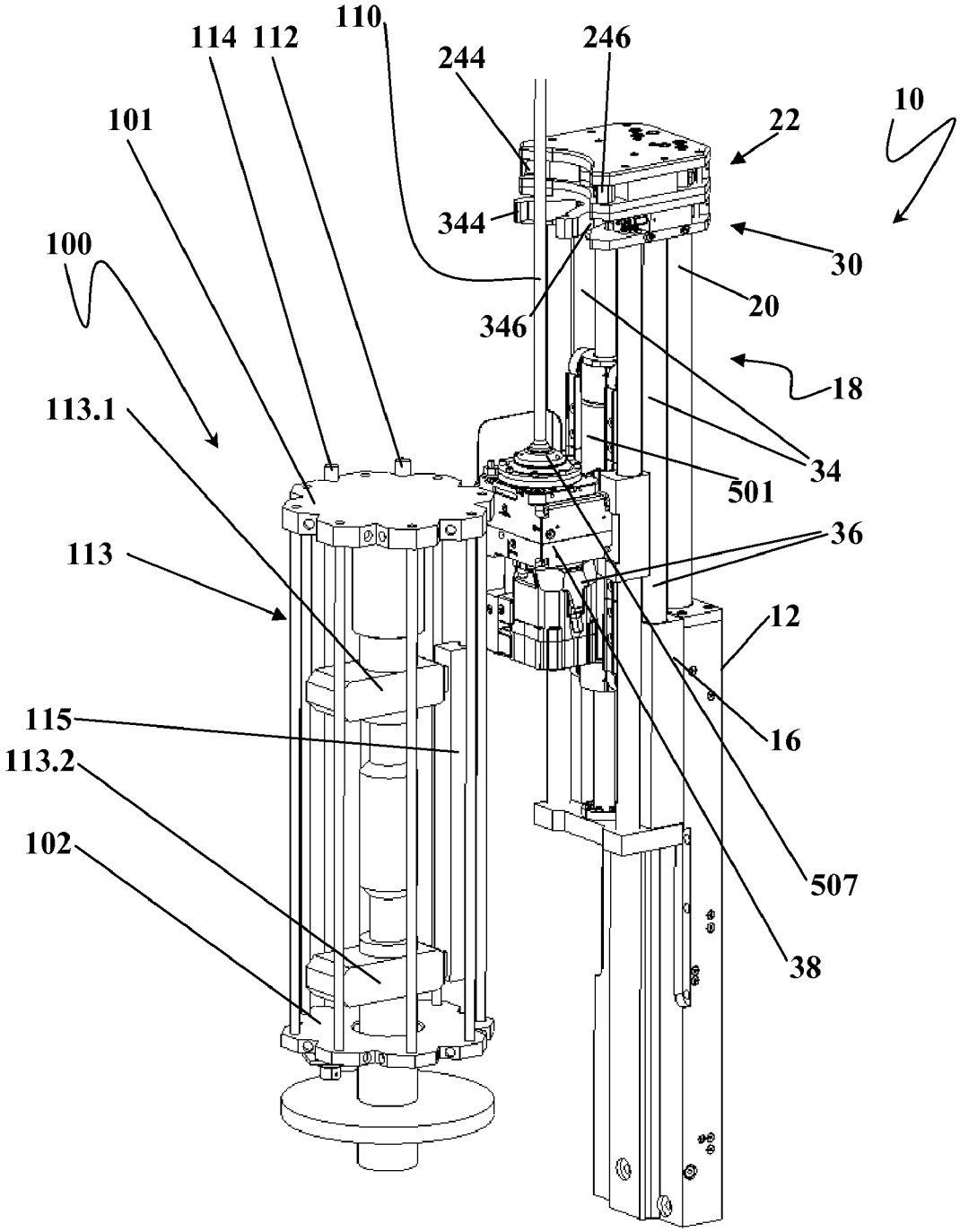

Once the feed frame 14 cannot move any further towards the mine roof or wall, the rotation unit 38 will then continue its movement towards the mine roof or wall by movement from second stage feed cylinder 501, which will slide the rotation unit 38 along the feed frame 14 as illustrated in FIG. 19.

Figure 20:
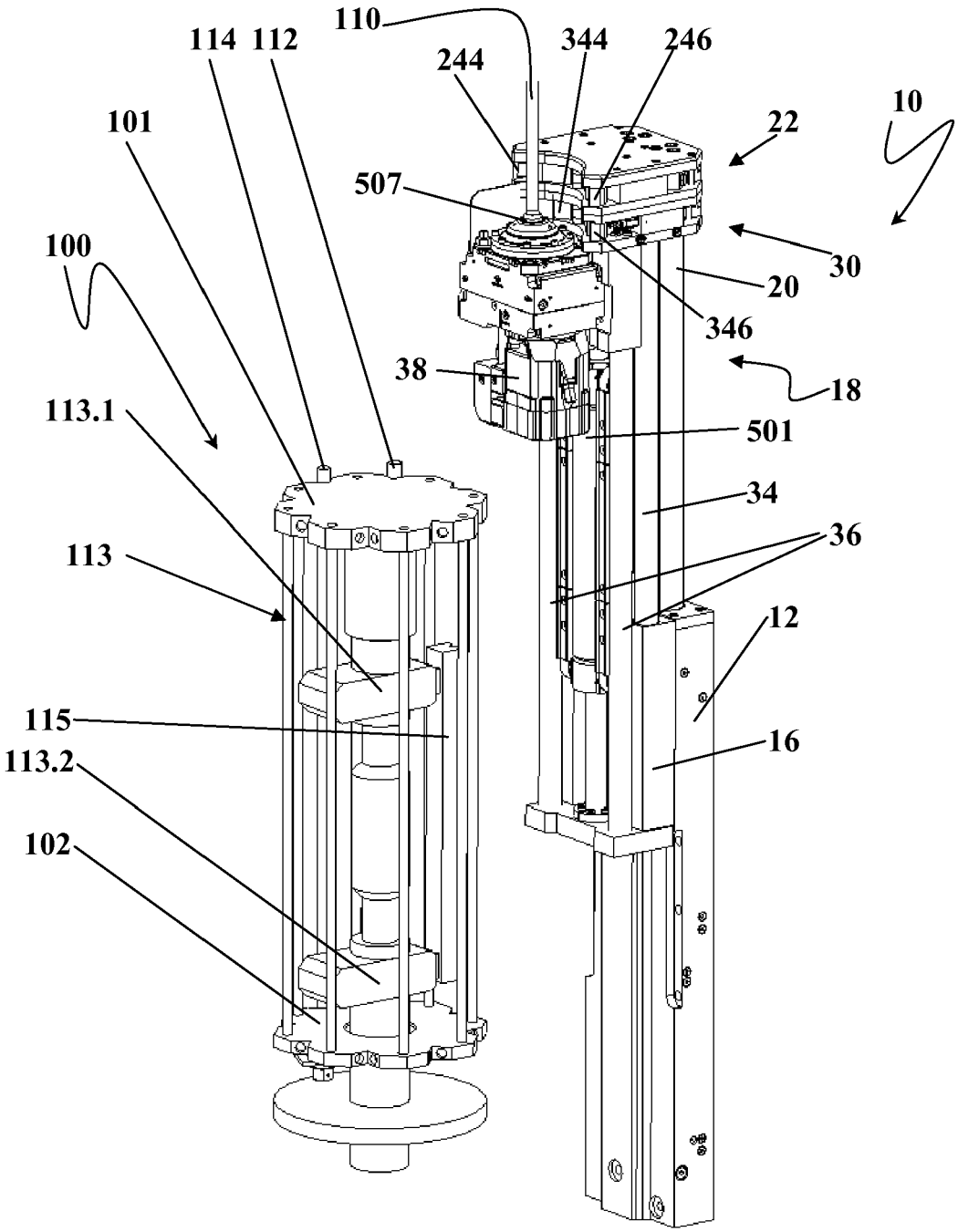

As illustrated in FIG. 19, once the drill rod 110 has entered the mine roof or wall, the arms 244 and 246 of plate assembly 22 can be retracted fully, whereby the arms 344 and 346 maintain their locating function. As the rotation unit 38 continues to move under the influence of second stage cylinder 501 and approaches the under side of plate assembly 30, the arms 344 and 346 are also retracted as illustrated in FIG. 19 (if desired the arms 244 and 246 can be retracted at the same time as the arms 344 and 346). Thus, as the drilling unit 38 approaches the plate assembly 30, the drilling unit 38 can progress to its maximum travel along the length of the feed frame. The clearance required will be dependent upon the type of rotation unit 38 used and the chuck 507 mounted thereon. In FIG. 20 the rotation unit 38 can be seen at or approaching its maximum distance of travel on feed frame 14.

Figure 21:
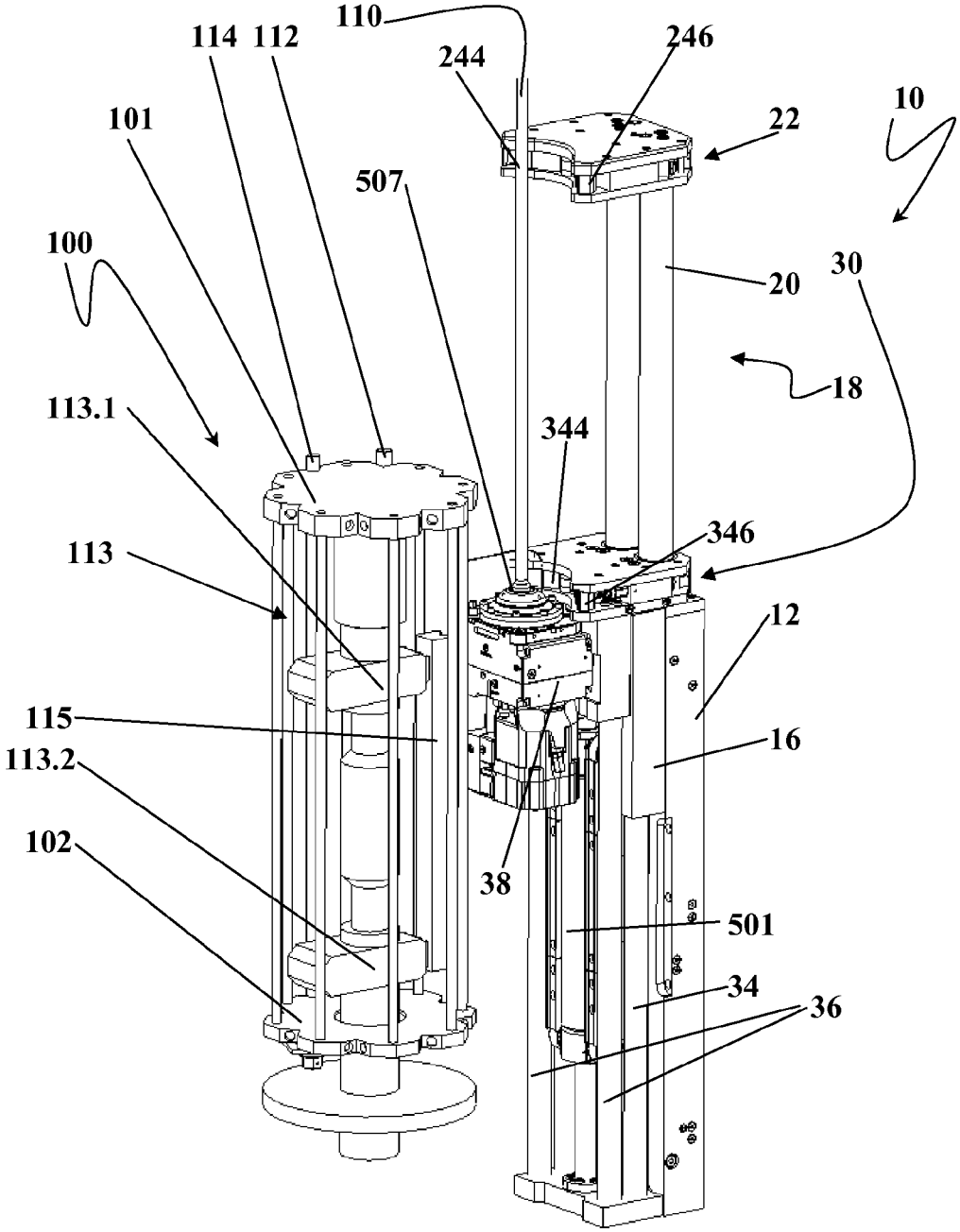

Once the drill rod 110 has completed its operation (or a roof bolt 112 has been installed), the rig 10 would begin to retract. As is illustrated in FIG. 21, where a reusable drill rod 110 has been utilized, the feed frame 14 retracts to its fully retracted condition relative to the base 12, with the rotation unit 38 still being maintained at its maximum travel on feed frame 14. It will be noted from FIG. 21, that the arms 244, 246, 344 and 346 are in the full retracted condition, as the feed frame 14 is moved back to the fully retracted condition.

The sequencing valves 390 & 392 ensure that this first stage retraction occurs before the second stage begins retraction of the rotation unit 38 relative to the feed frame 14. So once the feed frame 14 is fully retracted relative to the base 12, the rotation unit 38 begins retracting relative to the feed frame 14.

Figure 22:
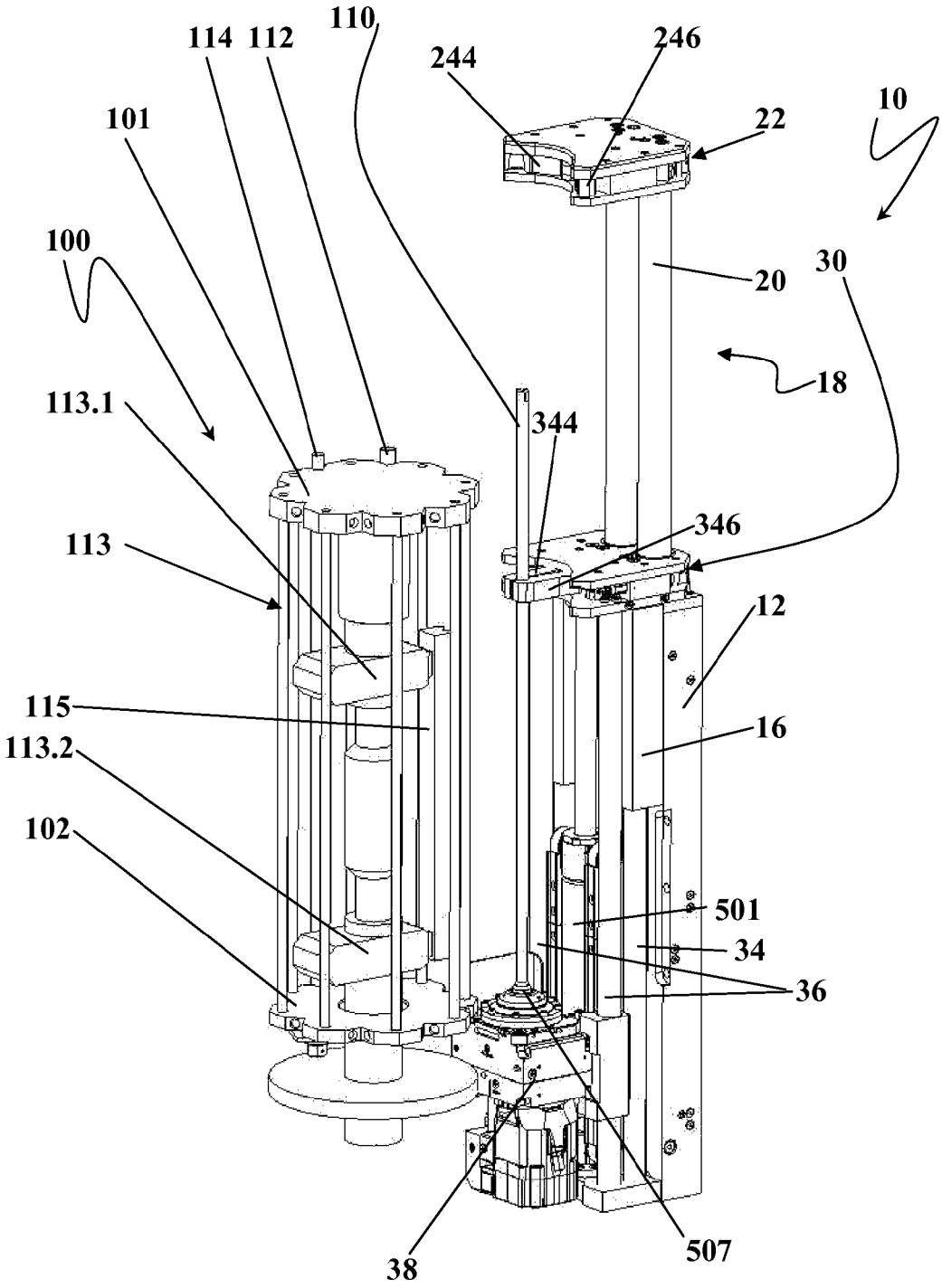

Once the rotation unit 38 is moved to the position illustrated in FIG. 22, the arms 344 and 346 can close around the rod 110 in a gripping manner to prevent any relative movement of the rod with respect to the jaws 348.

When the second stage retraction first begins, the rod 110 is located by the drilled hole in the mine entry and the rotation unit 38. It is not expected that the drilled hole will allow the rod 110 to stray too far from the rotation axis of the rotation unit 38, to the point where the converging jaws 348 would fail to operate. However, if this were a risk then the arms 244 and 246 can be made to locate the rod 110 until arm 344 and 346 have located the rod. This may require the second stage feed to stop while the arms 344 and 346 locate the rod 110 due to the grip then relax functionality of the relaxing mechanism 388. Another method of handling this misalignment would be to change the shape of the jaws 348 to allow a longer lead in to cope with a greater degree of misalignment.

In the illustration of FIG. 22 the rod 110 has been placed at an appropriate location with respect to the carousel 100, and allows the arms 344 and 346 and rotation unit 38 to hold the rod 110 in that position until the cradle 115 comes from carousel 100 to engage and retract the drill rod 110 back to the carousel.

Figure 23:
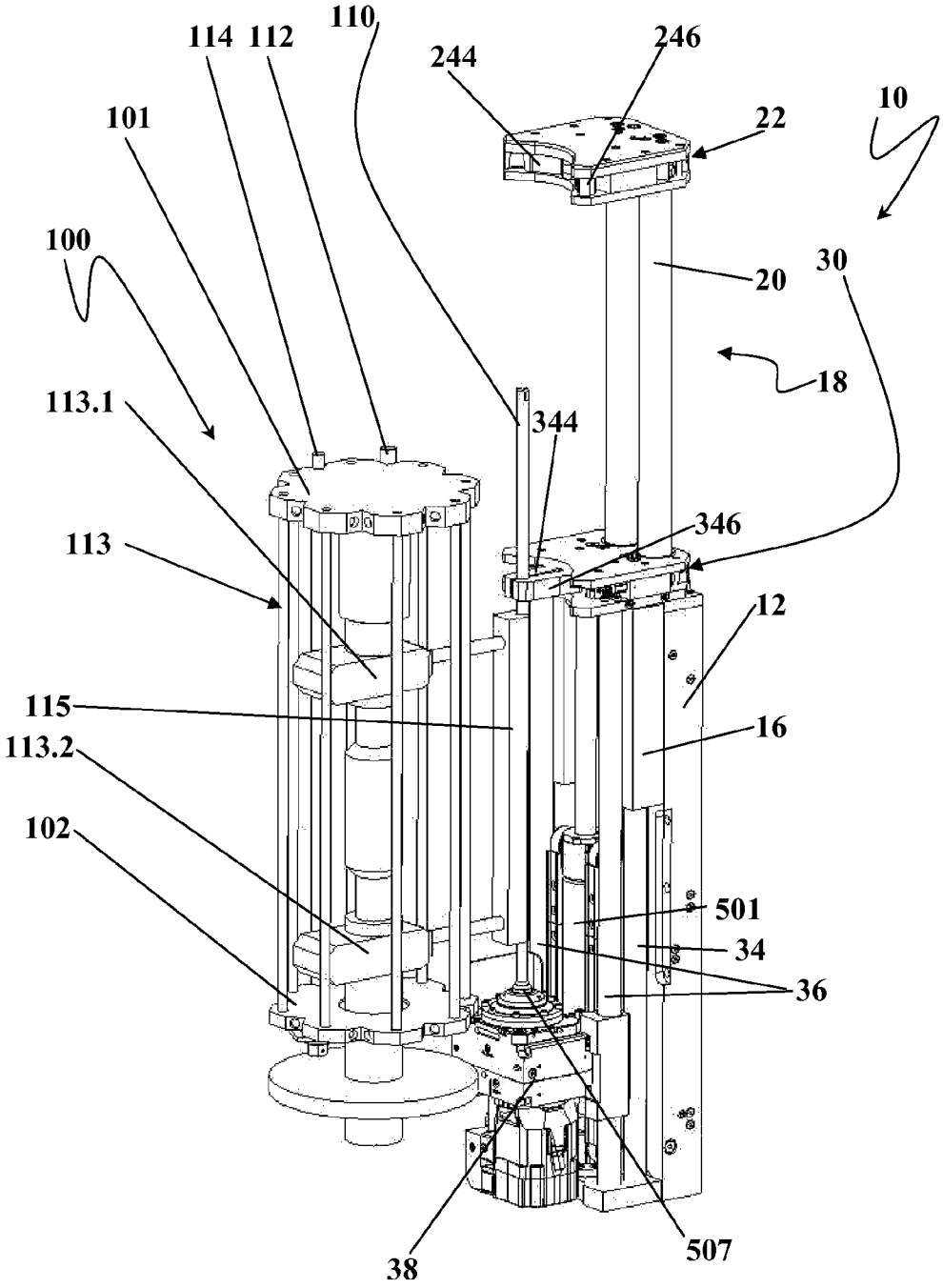

As illustrated in FIG. 23 the cradle 115 has moved to the drill rod 110 and magnetically engages it. The jaws 348 on arms 344 and 346 continue their gripping of rod 110 (or are made to grip the rod 110), to prevent all relative movement of the rod 110 with respect to the arms 344 and 346. It will be noted that the rotation unit 38 at this time is still engaging the drive end of the rod 110, and has not proceeded to the full length of its retraction travel on the feed frame 14.

It should be noted that during the first and second stage retraction process the rod is being rotated at a relatively slow speed, either in a drilling direction or the opposite direction, as this helps to keep friction between the drilled hole and the rod 110 to a minimum.

Figure 24:
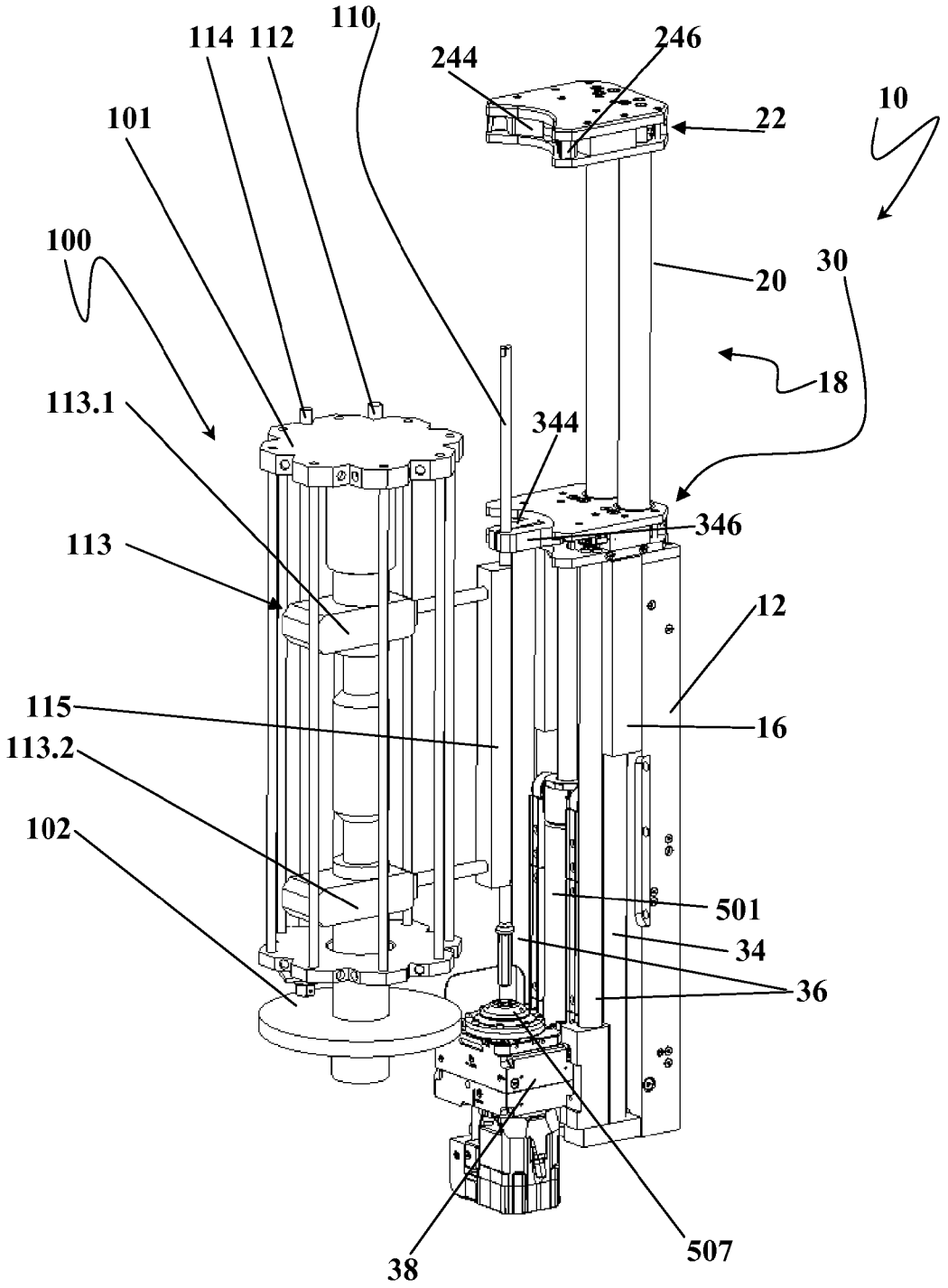

Once the rod 110 has been gripped by arms 344 and 346 and the cradle 115 is engaging the rod 110, then the rotation unit 38 can move to its fully retracted condition on the feed frame 14 as illustrated in FIG. 24. The jaws 348 and arms 344 and 346 are still gripping the rod 110, but once the rotation unit 38 has moved to its fully retracted condition the arms 344 and 346 can begin to open or retract fully to within the confines of the plate assembly 30.

Figure 25:
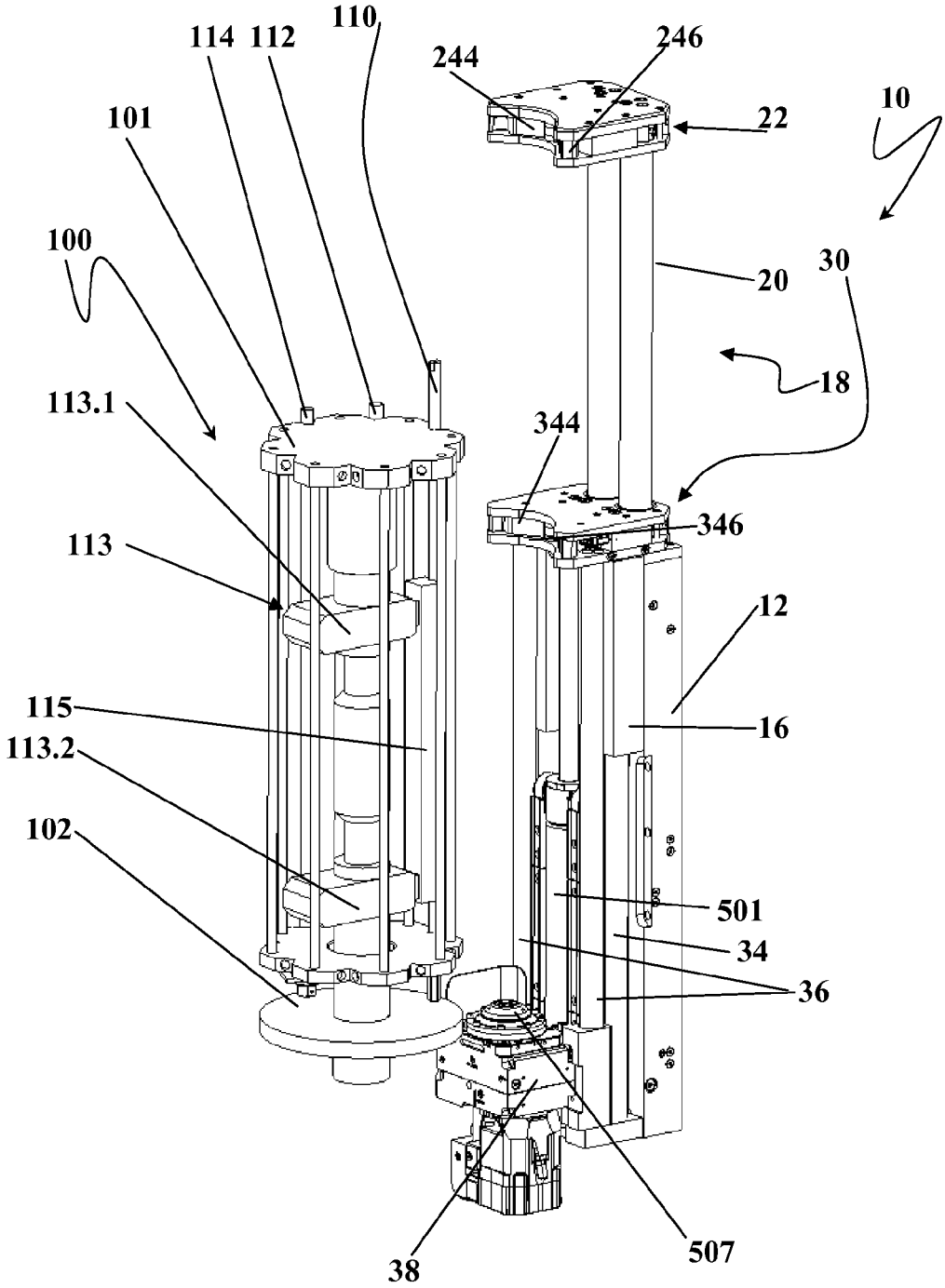

Once the jaws 348 on arms 344 and 346 have cleared the rod 110, the cradle 115 can be retracted by the cylinders 113.1 and 113.2 so that the rod 110 can be returned to the spiders 101 and 102 on carousel 100 as in FIG. 25.

It will be noted in FIGS. 21 to 25 that the arms 244 and 246 are in the fully retracted condition. If desired the arms 244 and 245 can be made to locate the rod 110 once the rotation unit 38 has cleared the plate assembly 22. This will maintain the arms 244 and 246 in the fully extended condition for the next rod to be located thereby. However, if the timber jack 18 were to be retracted the arms 244 and 246 would be best in the retracted condition.

It might be necessary for an operator to override the automatic operation and manually cause the rod to be gripped with the jaws 348 and arms 344 and 346 on the plate assembly 30 and move the whole feed frame down because the rod may have jammed up in the hole recently drilled in the mine roof or wall. This might be necessary as the connection between the drive end of the drill rod 110 and the drive unit of the rotation unit 38 would generally rely on friction and gravity for the two to move in unison as the rotation unit 38 moved away from the mine entry. That is the base or drive end of the rod does not lock into the drive of the rotation unit 38. One advantage of the arms 344 and 346 on the plate assembly 30 is that as an operator or automated system can use those arm and jaw system for extraction or retraction of a rod 110, the need for a twist lock chuck is diminished, thus potentially decreasing the complexity of the chuck and possible costs associated therewith.

In the case of a roof bolt or a self drilling roof bolt having been installed the timber jack 18 would retract then the mine vehicle trammed to a new location and the process begin again.

In the case of a reusable drill rod 110 having been used and retracted so that a roof bolt could now be installed, or in the case of extended drilling where another drill rod will be attached to the base of a drill rod left in the mine roof or wall for the purpose of drilling to multiple lengths of drill rods so as to receive a cable anchor so, then in these cases the timber jack 18 as illustrated in FIG. 25 would remain in the extended condition while the spiders 101, 102 of the carousel 100 are rotated to a new location to position a roof bolt onto the rotational axis, as is illustrated in FIG. 16.

The arms 244 and 246 on the plate assembly 22 and the arms 344 and 346 on the plate assembly 30 by being both fully retracted to within the confines of their respective plate assemblies, will allow the passage of a roof bolt 112 or self drilling roof bolt having a square or circular washer plate at the end thereof to pass by when the roof bolt is being installed. As would be understood in the art a chemical anchor would also need to be inserted into the drilled hole to anchor the bolt inserted.

A tube of chemical needing to be inserted into a drilled hole can be mounted inside a steel tube to be held on the carousel 100, and the tube of chemical ejected out of the steel tube by for example water pressure from the rotation unit, in which case the steel tube can be automatically handled by the carousel and the rig, in the manner described above.

The relaxing mechanism 388 as described above will operate at any pressure. If desired pressure limiters can be used in conjunction with the relaxing mechanism 388, so that for example the relaxing mechanism will only function if a predetermined pressure is reached in the relaxing circuit. This predetermined pressure could be variable or adjustable as desired. Further the relaxing mechanism can include a means to vary the volume of chamber 388.1, so that the relaxer can be calibrated depending upon the outer diameter of the rods to be used with the rig 10. Such means to vary the volume could include a limiter to limit the travel of the piston 360, or a formation which can be occluded to vary the volume of chamber 388.1.

While the above description and drawings illustrate a vertically arranged carousel system, it will be readily understood that the inventions described herein are readily utilised with other supply systems of rods, such as those which store and handle the rods by different means such as by belts, cartridge type arrangements etc.

A particular benefit of the rig 10 is that the rig can automatically, or an operator can cause the rig to grab the drill rod 110 by the arms 344 and 346 on the plate assembly 30 whilst maintaining the timber jack 18 in its upright condition. In prior art systems this could not be done as the centralizer units were located exclusively in the top plate of the timber jack.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

Throughout the description and claims the word "rod" or "rods" can refer to any one of a roof bolt, a drill steel, a drill, a self drilling roof bolt (which is a roof bolt having a drill at one end), a coring tube or rod, or chemical anchor tube or other equipment which may be used by a bolting apparatus, which equipment will generally have a generally elongated cylindrical shape.

Throughout the description and claims the words "roof bolt" and derivations of these words are taken to include other strata stabilisation articles and other similar named bolting articles such as rock bolts, anchor bolts, anchor tendons, tendons and any other similar articles which can be used for any purpose including drilling and bolting of ribs, floors, walls, rooves and surfaces of mines and any other location requiring strata stabilisation.

The expression "roof bolter" and "bolting apparatus" when used in this specification and claims means an apparatus able to be predominantly used for roof bolting processes, but is also able to be used exclusively for drilling or coring purposes, without any actual installation of roof bolts. In which latter case the drilling unit, timber jack component and other components are simply used for drilling and or coring purposes alone.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A bolting apparatus f or inserting a rod into a surface, said bolting apparatus including a base having a foot end and a head end, at least one stabilizing rod extendable from said base head end and having a stabilizing rod end adapted to contact a surface to be drilled, a mechanism directly attached to said base between said base foot end and said stabilizing rod end and adapted to grip the rod to be inserted by the bolting apparatus, a rotation unit slidably mounted to said base. and means for moving said rotation unit relative to said base.

2. An apparatus as claimed in claim 1 wherein said mechanism includes a relaxer means whereby when activated, said relaxer means reduces the gripping force of said mechanism on said rod while preventing said rod from translating laterally relative to a longitudinal axis of said rod.

3. An apparatus as claimed in claim 1 wherein said apparatus further includes a plate assembly connected to said at least one stabilizing rod extendable from said base.

4. An apparatus as claimed in claim 1 wherein said mechanism includes a body and elongated arms pivotally mounted at a proximal end thereof to said body, said arms when retracted having an angle between them of between 90 degrees and 180 degrees.

5. A bolting apparatus for inserting a rod into a surface, said bolting apparatus including a base having a foot end and a head end, at least one stabilizing rod extendable from said base head end and having a stabilizing rod end adapted to contact a surface to be drilled, and a mechanism directly attached to said base between said base foot end and said stabilizing rod end and adapted to grip the rod to be inserted by the bolting apparatus and further including a rotation unit feed frame slidably mounted to said base, said feed frame including a base member and an upper member, at least one first frame member and at least one second frame member, said base member and upper member being secured to respective ends of said a least one first and said second frame members whereby said at least one first and second frame members are spaced apart and substantially parallel to each other, at least one first frame member being adapted to be mounted to and slide relative to said base and said at least one second frame member being able to receive a rotation unit thereon whereby said rotation unit can slide relative to said second frame member, means for moving said feed frame relative to said base, and means for moving said rotation unit relative to said feed frame.

6. An apparatus as claimed in claim 5 wherein said mechanism receives motive power from said base via said means for moving said feed frame relative to said base.

7. An apparatus as claimed in claim 5 wherein said mechanism is mounted to at least one plate.

8. An apparatus as claimed in claim 7 wherein said at least one plate is mounted to at least one of said first and or second frame members.

9. An apparatus as claimed in claim 7 wherein said base includes a cylinder and piston arrangement which connects to said at least one plate to move said feed frame relative to said base.

10. An apparatus as claimed in claim 7 wherein all moving components of said mechanism retract within the footprint of said plate.

11. An apparatus as claimed in claim 7 wherein said plate is sized and shaped to allow a rod and washer plate to move vertically past said plate when said rod is collinear with the axis of rotation of said rotation unit.

12. An apparatus as claimed in claim 5 wherein said feed frame includes a cylinder and piston arrangement which makes connection with said upper member to provide power to motivate said mechanism.

* * * * *